US010161656B2

(12) United States Patent
Cho et al.

(10) Patent No.: US 10,161,656 B2
(45) Date of Patent: Dec. 25, 2018

(54) AIR CONDITIONER HAVING A BENDING TUBE WHICH ALTERS THE FLOW OF THE REFRIGERANT PRIOR TO ENTERING THE DISTRIBUTOR

(71) Applicant: LG ELECTRONICS INC., Seoul (KR)

(72) Inventors: Eunjun Cho, Seoul (KR); Beomsoo Seo, Seoul (KR); Kiwoong Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 446 days.

(21) Appl. No.: 14/688,246

(22) Filed: Apr. 16, 2015

(65) Prior Publication Data

US 2016/0047580 A1 Feb. 18, 2016

(30) Foreign Application Priority Data

Aug. 14, 2014 (KR) ..... 10-2014-0105770

(51) Int. Cl.

| | |
|---|---|
| ***F25B 41/06*** | (2006.01) |
| ***F25B 39/02*** | (2006.01) |
| ***F25B 21/02*** | (2006.01) |
| ***F28F 9/02*** | (2006.01) |
| ***F24F 1/14*** | (2011.01) |

(52) U.S. Cl.

CPC ..... *F25B 21/02* (2013.01); *F24F 1/14* (2013.01); *F28F 9/026* (2013.01); *F28F 9/027* (2013.01); *F28F 9/0275* (2013.01)

(58) Field of Classification Search

CPC ..... F28F 9/027; F28F 9/0275

USPC ..... 62/525–527

See application file for complete search history.

(56) References Cited

U.S. PATENT DOCUMENTS 2,168,404 A * 8/1939 Grant ..... F25B 39/028 137/262
2,193,696 A * 3/1940 Ramsaur ..... F25B 39/028 137/262
4,341,086 A * 7/1982 Ishii ..... F25B 1/00 236/92 B (Continued)

FOREIGN PATENT DOCUMENTS

CN 201653010 U 11/2010
CN 102135352 A 7/2011

(Continued)

*Primary Examiner* — Filip Zec

(74) *Attorney, Agent, or Firm* — Birch, Stewart, Kolasch & Birch, LLP

(57) ABSTRACT

An air conditioner includes a heat exchanger including a plurality of refrigerant tubes, a distributor disposed on one side of the heat exchanger to divide a refrigerant so that the refrigerant flows into a plurality of flow paths, a plurality of capillary tubes extending from the distributor toward the plurality of refrigerant tubes, a guide tube guiding an introduction of the refrigerant into the distributor, an inlet tube connected to an inlet-side of the distributor, and a bending part disposed between the guide tube and the inlet tube to switch a flow direction of the refrigerant. The inlet tube extends in a horizontal direction or an inclined direction to guide a liquid refrigerant of a two-phase liquid refrigerant so that the liquid refrigerant flows into a lower portion of the inlet tube.

9 Claims, 22 Drawing Sheets

(56) References Cited

U.S. PATENT DOCUMENTS

| | | | | | |
|---|---|---|---|---|---|
| 4,586,566 | A * | 5/1986 | Kern | F28F 9/0202 | 156/258 |
| 4,911,236 | A * | 3/1990 | Laveran | F25B 39/02 | 165/175 |
| 5,243,838 | A * | 9/1993 | Ide | F25B 39/028 | 62/504 |
| 5,743,111 | A * | 4/1998 | Sasaki | F25B 13/00 | 165/110 |
| 5,842,351 | A * | 12/1998 | Earhart, Jr. | F28F 9/26 | 62/117 |
| 5,970,741 | A * | 10/1999 | Tosha | F25B 39/028 | 62/504 |
| 8,763,424 | B1 * | 7/2014 | Albertson | F25B 39/028 | 62/498 |
| 8,931,509 | B2 * | 1/2015 | Beard | F25B 39/028 | 137/561 A |
| 2008/0041097 | A1 | 2/2008 | Oya et al. | | |
| 2010/0115979 | A1 * | 5/2010 | Lee | F25B 39/028 | 62/259.1 |
| 2010/0313585 | A1 * | 12/2010 | Parker | F25B 39/028 | 62/208 |

FOREIGN PATENT DOCUMENTS

| | | | |
|---|---|---|---|
| CN | 102374704 | A | 3/2012 |
| DE | 19515527 | A1 | 10/1996 |
| EP | 2184564 | A2 | 5/2010 |
| EP | 2578967 | A2 | 4/2013 |
| EP | 2618077 | A2 | 7/2013 |
| JP | 2008-45859 | A | 2/2008 |
| JP | 5404489 | B2 | 1/2014 |

* cited by examiner

AIR CONDITIONER HAVING A BENDING TUBE WHICH ALTERS THE FLOW OF THE REFRIGERANT PRIOR TO ENTERING THE DISTRIBUTOR

CROSS-REFERENCE TO RELATED APPLICATIONS

The present application claims priority under 35 U.S.C. 119 to Korean Patent Application No. 10-2014-0105770, filed on Aug. 14, 2014, which is hereby incorporated by reference in its entirety.

BACKGROUND

The present disclosure relates to an air conditioner.

Air conditioners are appliances that maintain air within a predetermined space to the most proper state according to use and purpose thereof. In general, such an air conditioner includes a compressor, a condenser, an expansion device, and an evaporator. Thus, the air conditioner has a refrigerant cycle in which compression, condensation, expansion, and evaporation processes of a refrigerant are performed. Thus, the air conditioner may heat or cool a predetermined space.

The predetermined space may be variously provided according to a place at which the air conditioner is used. For example, when the air conditioner is disposed in a home or office, the predetermined space may be an indoor space of a house or building. On the other hand, when the air conditioner is disposed in a vehicle, the predetermined space may be a boarding space in which a person is boarded.

When the air conditioner performs a cooling operation, an outdoor heat-exchanger provided in an outdoor unit may serve as a condenser, and an indoor heat-exchanger provided in an indoor unit may serve as an evaporator. On the other hand, when the air conditioner performs a heating operation, the indoor heat-exchanger may serve as the condenser, and the outdoor heat-exchanger may serve as the evaporator.

FIG. 1 is a view illustrating a distributor and a variation in velocity of wind passing through a heat exchanger according to a related art.

Referring to FIG. 1(*a*), a heat exchanger 1 according to the related art includes a plurality of refrigerant tubes 2 arranged in a plurality of rows, a coupling plate 3 coupled to ends of the refrigerant tubes 2 to support the refrigerant tubes 2, and a header 4 for dividing a refrigerant to flow into the refrigerant tubes 2 or mixing the refrigerant passing through the refrigerant tubes 2.

The header 4 extends in a length direction along the arranged direction of the refrigerant tubes 2. For example, as illustrated in FIG. 1, the header 4 may extend vertically.

The heat exchanger 1 further includes a distributor 6. The distributor 6 may divide the refrigerant introduced into the heat exchanger 1 to flow into the plurality of refrigerant tubes 2 through a plurality of branch tubes 5 or mix the refrigerants passing through the plurality of refrigerant tubes 2 with each other through the plurality of branch tubes 5.

Each of the branch tubes 5 may include a capillary tube.

The heat exchanger 1 further includes a distributor connection tube 7 for introducing the refrigerant into the distributor 6 and an inlet/outlet tube 8 for guiding the refrigerant into or out of the heat exchanger 1.

In the above-described heat exchanger 1, the refrigerant may flow in directions opposite to each other when the cooling or heating operations are performed. Hereinafter, a case in which the heat exchanger 1 is an "outdoor heat exchanger" will be described as an example.

When the air conditioner performs the cooling operation, the outdoor heat exchanger 1 may serve as a condenser. In detail, the high-pressure refrigerant compressed in the compressor is introduced into the header 4 and then divided to flow into the plurality of refrigerant tubes 2. Then, the refrigerant is heat-exchanged with outdoor air while flowing into the plurality of refrigerant tubes 2. The heat-exchanged refrigerants are mixed with each other in the distributor 6 via the plurality of branch tubes 5 to flow into the indoor unit.

On the other hand, when the air conditioner performs the heating operation, the outdoor heat exchanger 1 may serve as an evaporator. In detail, the refrigerant passing through the indoor unit is introduced into the distributor 6 through the distributor connection tube 7. Also, the refrigerant may be introduced into the refrigerant tube 2 through the plurality of branch tubes 5 connected to the distributor 6, and the refrigerant heat-exchanged with the refrigerant tube 2 may be mixed in the header 4 to flow toward the compressor.

Referring to FIG. 1(*b*), a variation in speed of wind passing through the outdoor heat exchanger 1 according to positions of the outdoor heat exchanger 1 is illustrated. A blower fan for blowing external air may be disposed on a side of the outdoor heat exchanger 1. The external air passing through the outdoor heat exchanger 1 may vary in wind speed or amount according to installation positions of the blower fan or arrangements of structures around the outdoor heat exchanger.

For example, FIG. 1(*b*) illustrates a state in which an upper wind speed of the outdoor heat exchanger 1 is greater than a lower wind speed of the outdoor heat exchanger 1. In detail, when the blower fan is disposed at an upper portion of the outdoor heat exchanger 1, a wind speed at a portion of the outdoor heat exchanger 1 that is adjacent to the blower fan, for example, at the upper portion of the outdoor heat exchanger 1, may be greater than that at a lower portion of the outdoor heat exchanger 1.

In this case, the refrigerant of the refrigerant tube 2 disposed in the upper portion of the outdoor heat exchanger 1 may have relatively superior heat-exchange efficiency. However, the refrigerant of the refrigerant tube 2 disposed in the lower portion of the outdoor heat exchanger 1 may be deteriorated in heat-exchange efficiency. To solve the above-described limitation, the branch tube 5 extending toward an upper side of the outdoor heat exchanger 1 may have a length less than that of the branch tube 5 extending toward a lower side of the outdoor heat exchanger 1. In this case, an amount of refrigerant flowing into the branch tube 5 extending toward the upper side of the outdoor heat exchanger 1 may be greater than that of refrigerant flowing into the branch tube 5 extending toward the lower side of the outdoor heat exchanger 1.

As illustrated in FIG. 1, the distributor connection tube 7 according to the related art may have a bent shape to extend upward when being connected to the distributor 6. Also, the distributor 6 is connected to the distributor connection tube 7 to extend upward. The above-described configuration may vary according to installation conditions of the branch tube 5 connected to the heat exchanger 1 from the distributor 6 or interference conditions with other structures of the outdoor unit or indoor unit in which the heat exchanger is installed.

According to the above-described structure, almost identical gravities may be applied to the distributor connection tube 7 and the distributor 6 to prevent the gravity from being differently applied according to the refrigerant paths. Also, the distributor 6 and the distributor connection tube may be designed on the basis of a rated load of the air conditioner.

Here, the rated load may be a load corresponding to a rated flow rate of the refrigerant circulated into the air conditioner.

That is, the arrangement of the distributor as illustrated in FIG. 1 may be effective under the rated load condition of the air conditioner.

On the other hand, when the air conditioner operates under conditions different from the rated load condition, for example, when the air conditioner operates under a low load condition that is less than the rated load, and the heat exchanger serves as the evaporator, a deviation in a degree of superheat may significantly occur according to a path of refrigerant introduced into the heat exchanger from the distributor.

In detail, when the air conditioner operates at the rated load, i.e., when the rated flow rate of refrigerant is calculated, an evaporation pressure is relatively low, and humidity of the refrigerant is relatively high. Thus, a flow loss of the refrigerant flowing into the branch tube 5 may be somewhat large.

Thus, a length or position of the path of the refrigerant flowing from the distributor 6 to the heat exchanger 1 may be designed in consideration of the pressure loss. For example, since the path having a relatively large pressure loss has a relatively small refrigerant flow rate, the path is connected to a low-wind speed side of the heat exchanger. Also, since path having a relatively small pressure loss has a relatively large refrigerant flow rate, the path is connected to a high-wind speed side of the heat exchanger.

On the other hand, when the air conditioner operates at a low load that is less than the rated load, i.e., when the refrigerant having a low flow rate that is less than the rated flow rate is circulated, the evaporation pressure may be relatively high, and the humidity of the refrigerant may be relatively low. Thus, the refrigerant flowing into the branch tube 5 may have a relatively lower pressure loss.

In this case, since a difference in refrigerant flow rate of the refrigerant flowing into the plurality of branch tubes 5 is not large, the refrigerant flowing toward the high-wind speed side of the heat exchanger may be excessively heated, or the refrigerant flowing toward the low-wind speed side of the heat exchanger may not be well heated in the case of the design of the distributor and heat exchanger at the rated load.

FIG. 2A illustrates a temperature variation and evaporation temperature at an inlet, a middle portion, and an outlet of the heat exchanger in each path of the heat exchanger when the air conditioner operates at the rated load. The evaporation temperature may be understood as a temperature after the refrigerants of the plurality of paths, which pass through the heat exchanger, are mixed with each other.

Also, FIG. 2B illustrates a temperature variation and evaporation temperature at the inlet, the middle portion, and the outlet of the heat exchanger in each path of the heat exchanger when the air conditioner operates at the low load.

Referring to FIG. 2B, the degree of the superheat may be determined as a difference value between the evaporation temperature and the outlet temperature in each path. In case of the path 5 of the heat exchanger, the degree of superheat is about 5° C. that is a difference value between the outlet temperature (about 24° C.) and the evaporation temperature (about 19° C.) of the heat exchanger. That is, the degree of superheat of path 5 is greater than that (about 1° C. to about 3° C.) of each of the other paths.

Thus, in case of the arrangement of the distributor according to the related art, it is seen that a deviation in degree of superheat in each path of the heat exchanger is significantly large.

As a result, when the air conditioner operates under the conditions other than the rated load condition, such as a low load condition, a deviation in degree of superheat of the refrigerant passing through the heat exchanger may be large, which tends to deteriorate operation performance of the air conditioner.

This limitation may occur where the heat exchanger 1 is the outdoor heat exchanger as well as the indoor heat exchanger that serves as the evaporator according to the operation mode of the air conditioner.

SUMMARY

Embodiments provide an air conditioner having improved heat-exchange efficiency and operation performance.

In one embodiment, an air conditioner includes: a heat exchanger including a plurality of refrigerant tubes; a distributor disposed on one side of the heat exchanger to divide a refrigerant so that the refrigerant flows into a plurality of flow paths; a plurality of capillary tubes extending from the distributor toward the plurality of refrigerant tubes; a guide tube guiding an introduction of the refrigerant into the distributor; an inlet tube connected to an inlet-side of the distributor; and a bending part disposed between the guide tube and the inlet tube to switch a flow direction of the refrigerant, wherein the inlet tube extends or inclinedly extends in a horizontal direction to guide a liquid refrigerant of a two-phase refrigerant so that the refrigerant flows into a lower portion of the inlet tube.

The guide tube may vertically extend, and the refrigerant flowing upward along the guide tube may be introduced into the distributor via the bending part and the inlet tube.

The distributor may include a distributor body defining a flow space for the refrigerant; and a tube coupling part disposed on one surface of the distributor body, the tube coupling part having a plurality of coupling holes to which the plurality of capillary tubes are coupled.

The plurality of coupling holes may include: a lower coupling hole defined in a lower portion of the distributor to communicate with a high-wind speed side refrigerant tube of the plurality of refrigerant tubes; and an upper coupling hole defined in an upper portion of the distributor to communicate with a low-wind speed side refrigerant tube of the plurality of refrigerant tubes.

The heat exchanger may vertically extend, and the high-wind speed side refrigerant tube may be disposed in an upper portion of the heat exchanger, and the low-wind speed side refrigerant tube may be disposed in a lower portion of the heat exchanger.

The capillary extending from the lower coupling hole to the high-wind speed side refrigerant tube may have a length less than that of the capillary extending from the upper coupling hole to the low-wind speed side refrigerant tube.

One of the inlet tube and the distributor may be inserted into the other one.

The inlet tube may have inner diameters R1 and R1*a* greater than those R2 and R2*a* of an inflow part of the distributor.

The heat exchanger may include an outdoor heat exchanger disposed on a base of an outdoor unit.

The inlet tube may be disposed in parallel to the base.

An angle between the inlet tube and the base of the outdoor unit may be determined at an angle of about 0° to about 90°.

The heat exchanger may include an indoor heat exchanger provided in an indoor unit.

The inlet tube may be disposed in parallel to a front panel of the indoor unit.

An angle between the inlet tube and the front panel of the indoor unit may be determined at an angle of about 0° to about 90°.

The inlet tube may inclinedly extend upward from the bending part toward the distributor.

The inlet tube may inclinedly extend downward from the bending part toward the distributor.

The inlet tube may have a length of about 30 mm or more.

The details of one or more embodiments are set forth in the accompanying drawings and the description below. Other features will be apparent from the description and drawings, and from the claims.

DETAILED DESCRIPTION OF THE EMBODIMENTS

Hereinafter, exemplary embodiments will be described with reference to the accompanying drawings. The invention may, however, be embodied in many different forms and should not be construed as being limited to the embodiments set forth herein; rather, that alternate embodiments included in other retrogressive inventions or falling within the spirit and scope of the present disclosure will fully convey the concept of the invention to those skilled in the art.

Figure 3:
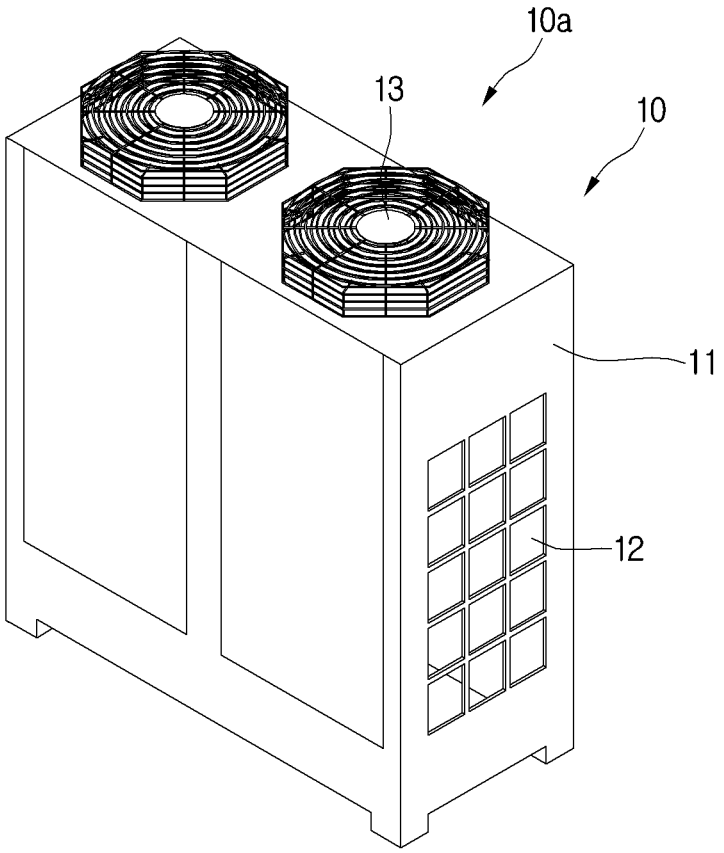
FIG. 3 is a view illustrating an exterior of an outdoor unit according to a first embodiment.
Figure 4:
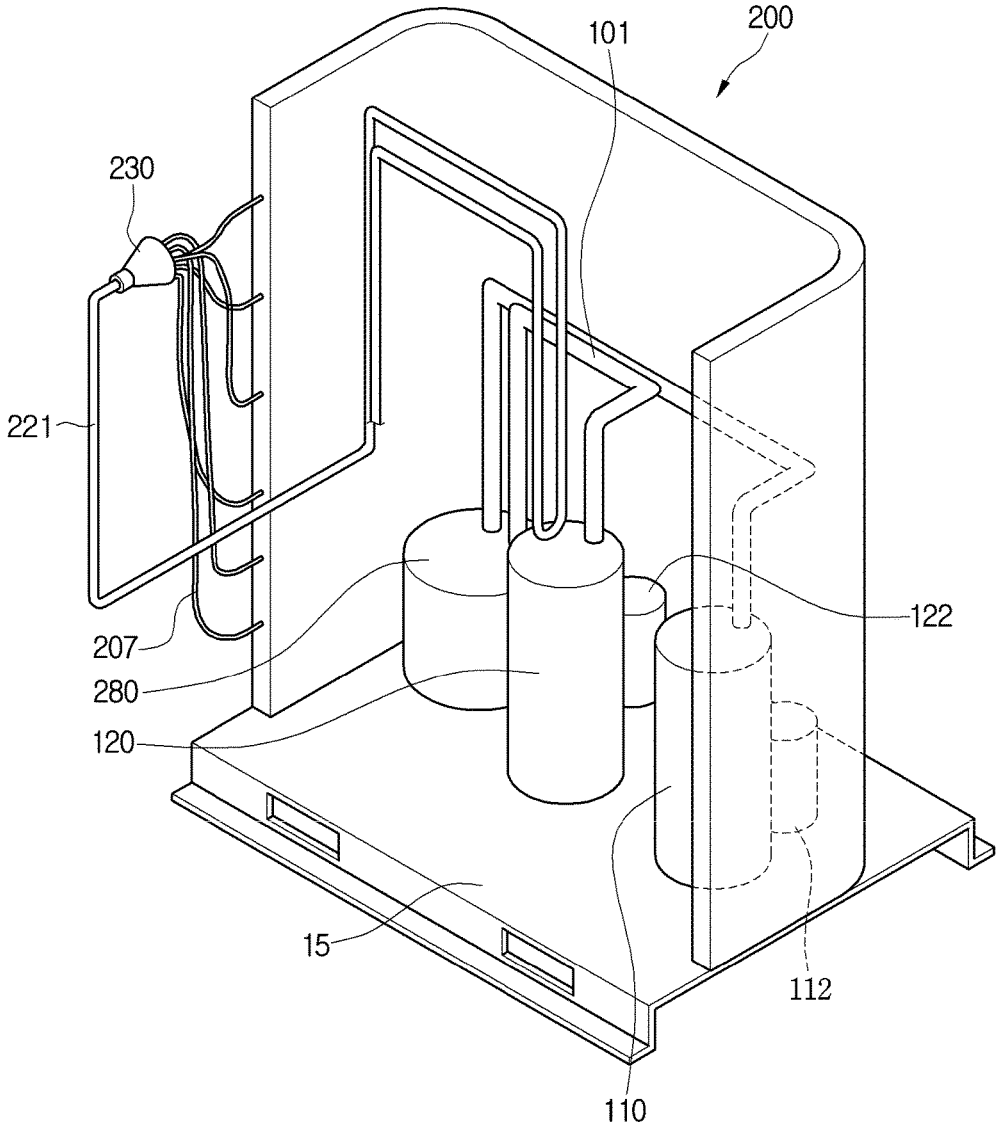
FIG. 4 is a schematic view of inner constitutions of the outdoor unit according to the first embodiment.

FIG. 3 is a view illustrating an exterior of an outdoor unit according to a first embodiment, and FIG. 4 is a schematic view of inner constitutions of the outdoor unit according to the first embodiment.

Referring to FIGS. 3 and 4, an air conditioner 10 according to a first embodiment includes an outdoor unit 10*a* for exchanging heat with outdoor air, and an indoor unit disposed in an indoor space to condition indoor air.

The outdoor unit 10*a* includes a case 11 defining an exterior thereof and including a plurality of built-in components. The case 11 includes a suction part 12 for suctioning the outdoor air and a discharge part 13 for discharging the suctioned air after the suctioned air is heat-exchanged. The discharge part 13 may be disposed on an upper end of the case 11.

The case 11 includes a plurality of compressors 110 and 112 for compressing a refrigerant, a gas/liquid separator 280 for filtering a liquid refrigerant from the refrigerant suctioned into the plurality of compressors 110 and 112, oil separators 120 and 122 respectively coupled to sides of the plurality of compressors 110 and 112 to separate an oil from the refrigerant discharged from the compressors 110 and 112, and an outdoor heat exchanger 200 for exchanging heat with the outdoor air.

The plurality of compressors 110 and 112, the gas/liquid separator 280, and the outdoor heat exchanger 200 may be disposed on a base 15 of the outdoor unit 10*a*. The base 15 may define a bottom surface of the outdoor unit 10*a* and have a surface that is approximately perpendicular to the direction of gravity.

The outdoor unit 10*a* may further include a refrigerant tube for guiding the refrigerant circulated into the outdoor unit 10*a*, i.e., the refrigerant flowing into the plurality of compressors 110 and 112, the gas/liquid separator 280, and the outdoor heat exchanger 200.

A distributor 230 for dividing the refrigerant into the outdoor heat exchanger 200 when the air conditioner 10 perform a heating operation, a guide tube 221 for introducing the refrigerant to the distributor 230, and a plurality of capillary tubes 207 of a branch tube extending from the distributor 230 into each path of the outdoor heat exchanger 200. Here, the outdoor heat exchanger 200 may serve as an evaporator.

The distributor 230 may extend in a direction that is parallel to one surface of the base 15. Descriptions relating to the above-described structure will be described later with reference to the accompanying drawings.

Figure 5:
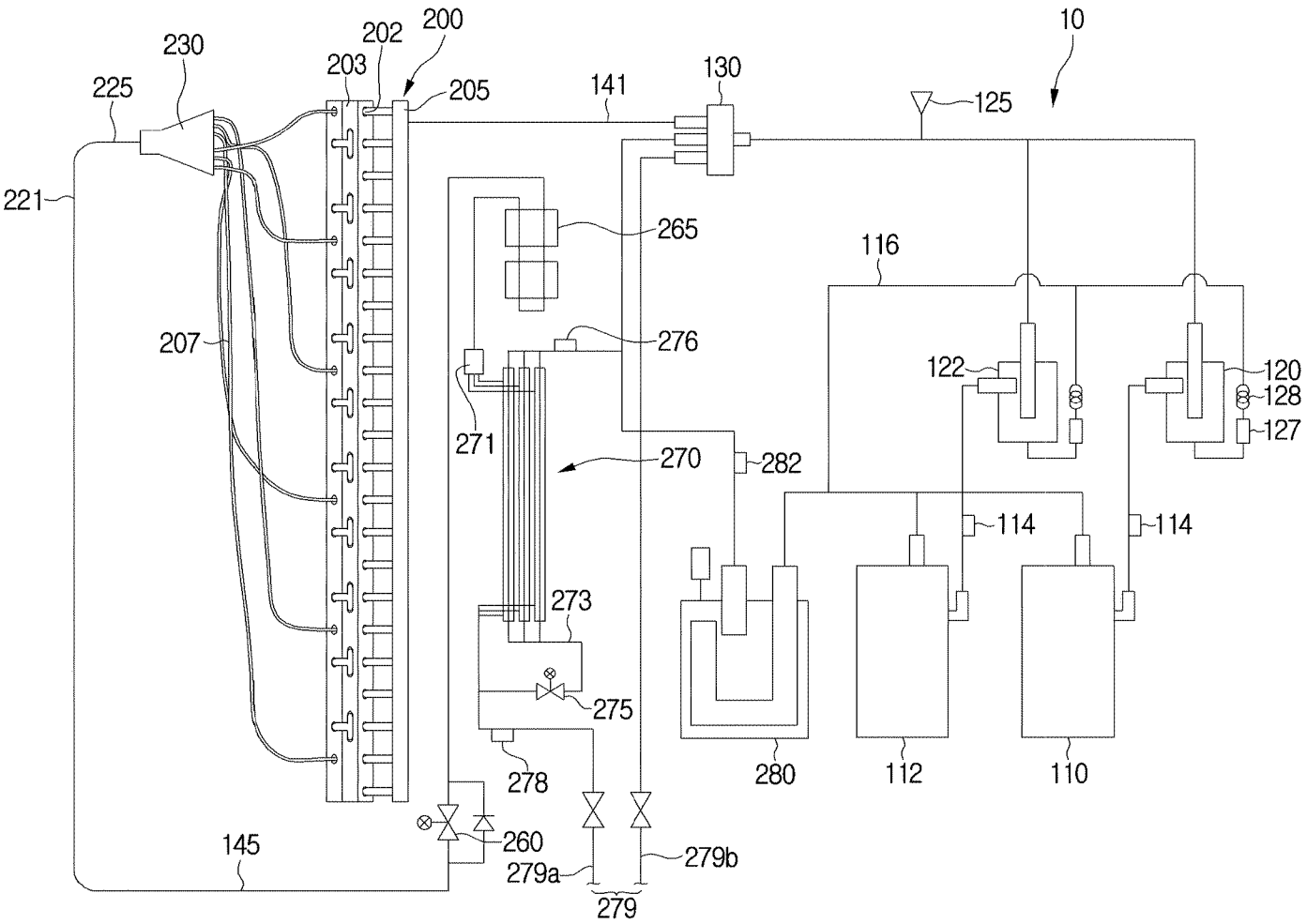
FIG. 5 is a system view illustrating constitutions of an air conditioner according to the first embodiment.
Figure 6:
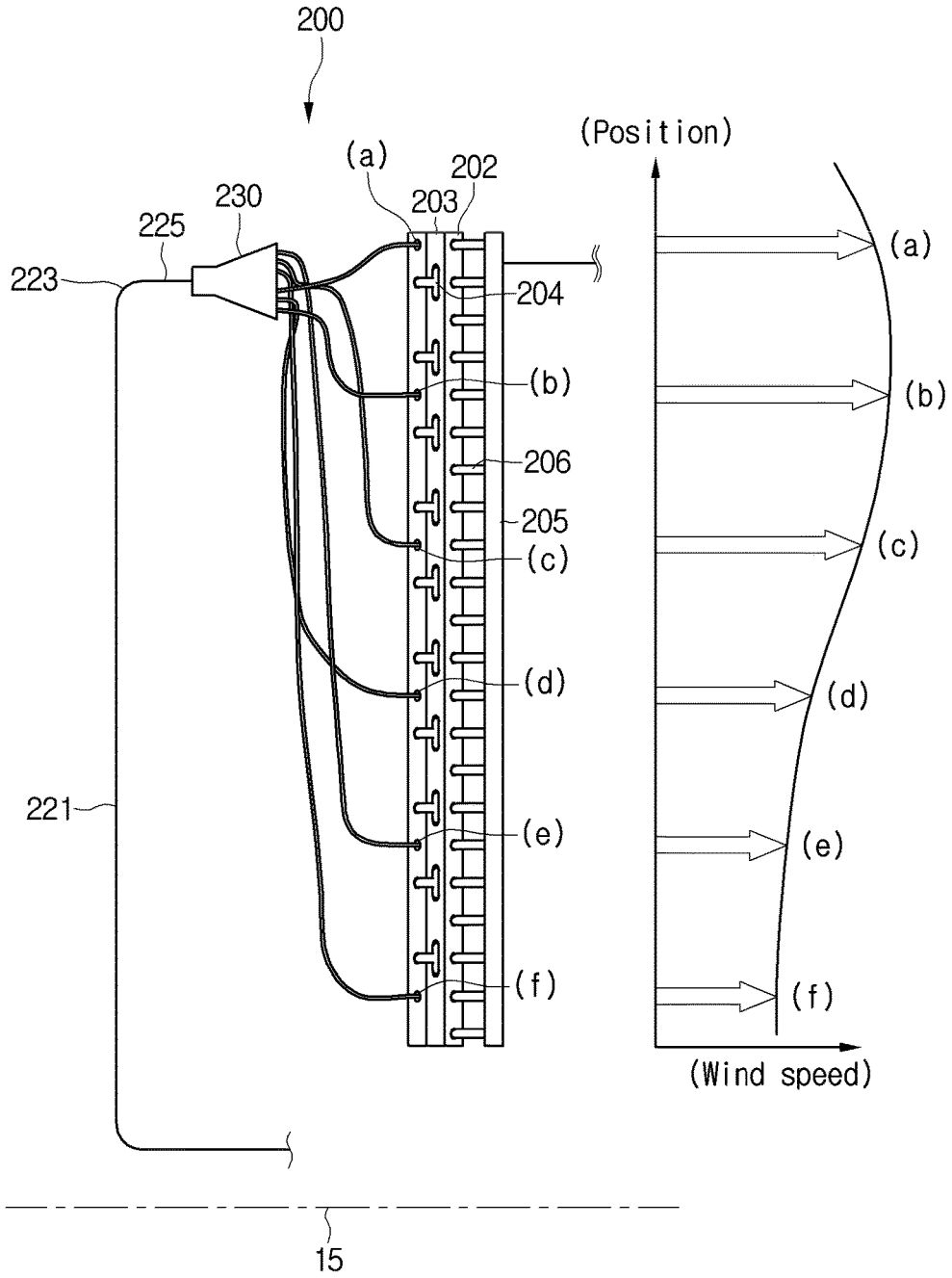
FIG. 6 is a view illustrating a distributor and a variation in speed of wind passing through an outdoor heat exchanger according to the first embodiment.

FIG. 5 is a system view illustrating constitutions of an air conditioner according to the first embodiment, and FIG. 6 is a view illustrating a variation in speed of wind passing through an outdoor heat exchanger according to the first embodiment.

Referring to FIGS. 5 and 6, the air conditioner 10 according to the first embodiment includes the outdoor unit (see reference numeral 10*a* of FIG. 4) disposed in an outdoor space, and an indoor unit (see reference numeral 30 of FIG. 13) disposed in an indoor space. The indoor unit 30 includes an indoor heat exchanger (see reference numeral 300 of FIG. 13) heat-exchanged with air of the indoor space.

The air conditioner 10 includes a plurality of compressors 110 and 112 and the oil separators 120 and 122 respectively disposed on outlet-sides of the plurality of compressors 110 and 112 to separate the oil from the refrigerant discharged from the plurality of compressors 110 and 112.

The plurality of compressors 110 and 112 include a compressor 110 and a second compressor 112, which are connected in parallel to each other. A discharge temperature sensor 114 for detecting a temperature of the compressed refrigerant may be disposed on an outlet-side of each of the first and second compressors 110 and 112.

Also, the oil separators 120 and 122 include a first oil separator 120 disposed on the outlet-side of the first compressor 110 and a second oil separator 122 disposed on the outlet-side of the second compressor 112.

The air conditioner 10 includes a collection passage 116 for collecting the oil from the oil separators 120 and 122 and feeding the oil back into the compressors 110 and 112. The collection passage 116 may extend from each of the outlet-sides of the first and second oil separators 120 and 122 then combined with each other. Here, the combined passage may be connected to the inlet-side tube of each of the first and second compressors 110 and 112.

A dryer 127 and a capillary 128 may be disposed in the collection passage 116.

A high-pressure sensor 125 for detecting a discharge pressure of the refrigerant discharged from the compressors 110 and 112 and a flow switching part 130 for guiding the refrigerant passing through the high-pressure sensor 125 to the outdoor heat exchanger 200 or the indoor unit are disposed on the outlet-sides of the oil separators 120 and 122. For example, the flow switching part 130 may include a four-way valve.

When the air conditioner performs a cooling operation, the refrigerant may be introduced from the flow switching part 130 into the outdoor heat exchanger 200 via a first inlet/outlet tube 141. The first inlet/outlet tube 141 may be understood as a tube extending from the flow switching part 130 to the outdoor heat exchanger 200.

On the other hand, when the air conditioner performs a heating operation, the refrigerant flows from the flow switching part 130 toward the indoor heat exchanger 300 of the indoor unit.

When the air conditioner operates in the cooling mode, the refrigerant condensed in the outdoor heat exchanger 200 passes through a main expansion valve 260 (electronic expansion valve) via a second inlet/outlet tube 145. Here, the main expansion valve 260 is fully opened so that the refrigerant is not decompressed. That is, the main expansion valve 260 may be disposed in an outlet-side of the outdoor heat exchanger 200 when the cooling operation is performed. Also, the second inlet/outlet tube 145 may be understood as a tube extending from the guide tube 221 to the main expansion valve 260.

The refrigerant passing through the main expansion valve 260 passes through a heatsink plate 265. The heatsink plate 265 may be disposed on an electronic unit including a heat generation component.

For example, the heat generation component may include an intelligent power module (IPM). The IPM may be understood as a driving circuit of a power device such as a power MOSFET or IGBT and a protection circuit having a self protection function.

The refrigerant tube guiding a flow of the condensed refrigerant may be coupled to the heatsink plate 265 to cool the heat generation component.

The air conditioner 10 further includes a supercooling heat exchanger 270 in which the refrigerant passing through the heat-sink plate 265 is introduced and a supercooling distributor 271 disposed on an inlet-side of the supercooling heat exchanger 270 to divide the refrigerant flow. The supercooling heat exchanger 270 may serve as an intermediate heat exchanger in which a first refrigerant circulated into the system and a portion (a second refrigerant) of the first refrigerant are heat-exchanged with each other after the refrigerant is branched.

Here, the first refrigerant may be a refrigerant that is introduced into the supercooling heat exchanger 270 via the supercooling distributor 271 and thus be supercooled by the second refrigerant. On the other hand, the second refrigerant may absorb heat from the first refrigerant.

The air conditioner 10 may includes a supercooling passage 273 disposed on an outlet-side of the supercooling heat exchanger 270 to branch the second refrigerant from the first refrigerant. Also, a supercooling expansion device 275 for decompressing the second refrigerant may be disposed in the supercooling passage 273. The supercooling expansion device 275 may include an electronic expansion valve (EEV).

The second refrigerant of the supercooling passage 273 may be introduced into the supercooling heat exchanger 270 and then be heat-exchanged with the first refrigerant to flow toward an inlet-side of the gas/liquid separator 280. The air conditioner 10 further includes a supercooling discharge temperature sensor 276 for detecting a temperature of the second refrigerant passing through the supercooling heat exchanger 270.

The gas/liquid separator 280 may be configured to separate a gaseous refrigerant from the refrigerant before the refrigerant is introduced into the compressors 110 and 112. The separated gaseous refrigerant may be introduced into the compressors 110 and 112.

While the refrigeration cycle is driven, the evaporated refrigerant may be introduced into the gas/liquid separator 280 via the flow switching part 130. Here, the evaporated refrigerant may be mixed with the second refrigerant passing through the supercooling heat exchanger 270 and then be introduced into the gas/liquid separator 280.

A suction temperature sensor 282 for detecting a temperature of the refrigerant to be suctioned into the compressors 110 and 112 may be disposed on the inlet-side of the gas/liquid separator 280.

The first refrigerant passing through the supercooling heat exchanger 270 may be introduced into the indoor unit through an indoor unit connection tube 279. The indoor connection tube 279 includes a first connection tube **279*a* connected to one side of the indoor heat exchanger 300 and a second connection tube 279*b* connected to the other side of the indoor heat exchanger 300. The refrigerant introduced into the indoor heat exchanger 300 through the first connection tube 279*a* flows into the second connection tube 279*b* after being heat-exchanged with the indoor heat exchanger 300**.

The air conditioner 10 further includes a liquid tube temperature sensor 278 disposed on the outlet-side of the supercooling heat exchanger 270 to detect a temperature of the first refrigerant passing through the supercooling heat exchanger 270, i.e., a temperature of the supercooled refrigerant.

Hereinafter, constitutions of the outdoor heat exchanger 200 and peripheral constitutions thereof will be described.

The air conditioner 10 includes the first inlet/outlet tube 141 extending from the flow switching part 130 to one side of the outdoor heat exchanger 200 and the second inlet/outlet tube 145 extending from the other side of the outdoor heat exchanger 200 to the main expansion device 260.

For example, the first inlet/outlet tube 141 may be connected to an upper portion of a header 205, and the second inlet/outlet tube 145 may be connected to a guide tube 221 connected to a side of the distributor 230 for dividing the refrigerant to flow into the outdoor heat exchanger 200, i.e., connected to the distributor 230.

When the air conditioner 10 performs the cooling operation, the refrigerant is introduced into the outdoor heat exchanger 200 through the first inlet/outlet tube 141 and is discharged from the outdoor heat exchanger 200 and the distributor 230 through the second inlet/outlet tube 145.

On the other hand, when the air conditioner 10 performs the heating operation, the refrigerant is introduced into the distributor 230 through the second inlet/outlet tube 145 and is branched into a plurality of paths at the distributor 230 and then introduced into the outdoor heat exchanger 200. Also, the refrigerant heat-exchanged in the outdoor heat exchanger 200 is discharged from the outdoor heat exchanger 200 through the first inlet/outlet tube 141.

The outdoor heat exchanger 200 includes a plurality of refrigerant tubes 202 having a plurality of rows and stages. The plurality of refrigerant tubes 202 may be spaced apart from each other.

The plurality of refrigerant tubes 202 may be bent to lengthily extend. For example, the plurality of refrigerant tubes 202 may extend again forward after extending backward from the ground. In this case, each of the plurality of refrigerant tubes 202 may have a U shape.

The outdoor heat exchanger 200 further includes a coupling plate 203 supporting the refrigerant tube 202. The coupling plate 203 may be provided in plurality to support one side and the other side of the refrigerant tube 202 having the bent shape. FIG. 6 illustrates one coupling plate 203 supporting one side of the refrigerant tube 202. The coupling plate 203 may lengthily extend in a vertical direction.

The outdoor heat exchanger 200 further include a return tube 204 coupled to an end of each of the plurality of refrigerant tubes 202 to guide the refrigerant flowing in one refrigerant tube 202 into the other refrigerant tube 202. The return tube 204 may be provided in plurality and be coupled to the coupling plate 203.

The outdoor heat exchanger 200 further includes the header 205 defining a flow space for the refrigerant. The header 205 may be configured to divide the refrigerant and introduce the divided refrigerant into the plurality of refrigerant tubes 202 according to the cooling or heating operation of the air conditioner 10 or mix the refrigerant heat-exchanged in the plurality of refrigerant tubes 202. The header 205 may lengthily extend in a vertical direction to correspond to the extension direction of the coupling plate 203.

A plurality of refrigerant inflow tubes 206 extend between the header 205 and the coupling plate 203. The plurality of refrigerant inflow tubes 206 extend from the header 205 and then are connected to the refrigerant tubes 202 supported by the coupling plate 203. Also, the plurality of refrigerant inflow tubes 206 may be vertically spaced apart from each other.

When the air conditioner performs the cooling operation, the refrigerant of the header 205 may be introduced into the refrigerant tubes 202 through the plurality of refrigerant inflow tubes 206. On the other hand, when the air conditioner performs the heating operation, the refrigerant of the refrigerant tubes 202 may be introduced into the header 205 through the plurality of refrigerant inflow tubes 206.

The air conditioner 10 further includes the distributor 230 for dividing the refrigerant to introduce the divided refrigerant into the outdoor heat exchanger 200, and the guide tube 221 guiding the refrigerant into the distributor 230. The guide tube 221 is coupled to the second inlet/outlet tube 145 to extend to an inflow-side of the distributor 230.

Here, the "inflow side" of the distributor 230 may represent a direction in which the refrigerant is introduced into the distributor 230 when the air conditioner performs the heating operation to allow the outdoor heat exchanger to serve as the evaporator. That is, the guide tube 221 and the second inlet/outlet tube 145 may be disposed between the main expansion valve 260 and the distributor 230.

The guide tube 221 may extend upward to correspond to the extension direction of the coupling plate 203 or the header 205.

The air conditioner 10 includes an inlet tube 225 disposed at the inflow-side of the distributor 230 to horizontally extend and a bending part 223 extending from guide tube 221 to the inlet tube 225. The bending part 223 may switch a flow direction of the refrigerant flowing upward through the guide tube 221 into a horizontal direction toward the inlet tube 225.

The inlet tube 225 may extend in a direction that is parallel to the base 15 of the outdoor unit 10*a*. In other words, the inlet tube 225 may extend in a direction that is perpendicular to the gravity direction of the inlet tube 225.

Thus, the refrigerant may flow upward through the guide tube 221 and then be switched at the bending part 223 to flow in an approximately horizontal direction. Then, the refrigerant may flow into the inlet tube 225 and then be introduced into the distributor 230. Since the inlet tube 225 extends in a horizontal direction, the refrigerant may horizontally flow toward an inlet part of the distributor 230.

The air conditioner 10 further include a plurality of capillary tubes 207 that are branch tubes from the distributor 230 to the plurality of refrigerant tubes 202. When the air conditioner 10 performs the heating operation, the refrigerant may be divided in the distributor 230 to flow into the refrigerant tubes 202 through the plurality of capillary tubes 207.

That is, the plurality of capillary tubes 207 are connected to the distributor 230, and the refrigerant divided in the distributor 230 flows along the plurality of paths and is then introduced into the plurality of refrigerant tubes 202.

The capillary tube 207 connected to a side (a high-wind speed side) of the outdoor heat exchanger 200 in which air flows at a high speed among the plurality of capillary tubes 207 may have a relatively short length to reduce a pressure loss of the refrigerant. Thus, an amount of refrigerant passing through the capillary tubes 207 may be relatively large. As illustrated in FIG. 6, the high-wind speed side of the outdoor heat exchanger 200 may be understood as refrigerant tubes 202 disposed at positions a, b, and c.

On the other hand, the capillary tube 207 connected to a side (a low-wind speed side) of the outdoor heat exchanger 200 in which air flows at a low-wind speed among the plurality of capillary tubes 207 may have a relatively long length to increase a pressure loss of the refrigerant. Thus, an amount of refrigerant passing through the capillary tubes 207 may be relatively less. As illustrated in FIG. 6, the low-wind speed side of the outdoor heat exchanger 200 may be understood as refrigerant tubes 202 disposed at positions d, e, and f.

Since the pressure loss of the refrigerant is reduced in the path into which a refrigerant having relatively low humidity flows of the refrigerant that is divided in the distributor 230 to flow into the plurality of paths, a relatively large amount of refrigerant may pass through the path. On the other hand, since the pressure loss of the refrigerant increases in the path into which a refrigerant having relatively high humidity flows, a relatively small amount of refrigerant may pass through the path.

Due to the above-described physical characteristics of the refrigerant, a connection structure of the distributor 230, the plurality of capillary tubes 207, and the outdoor heat exchanger 200 may be designed. Particularly, the optimized design may be realized on the basis of the refrigerant flow rate when the air conditioner operates at a rated load. However, as described in the related art, when the air conditioner operates at a low load, a deviation occurs in a degree of superheat of the refrigerant evaporated in the heat exchanger.

Thus, in the present embodiment, when the air conditioner operates at the low load, and thus a relatively small amount of refrigerant is circulated, the refrigerant having the low humidity may be introduced into a specific capillary tube to supply a large amount of refrigerant into the high-wind speed side of the outdoor heat exchanger.

Figure 7:
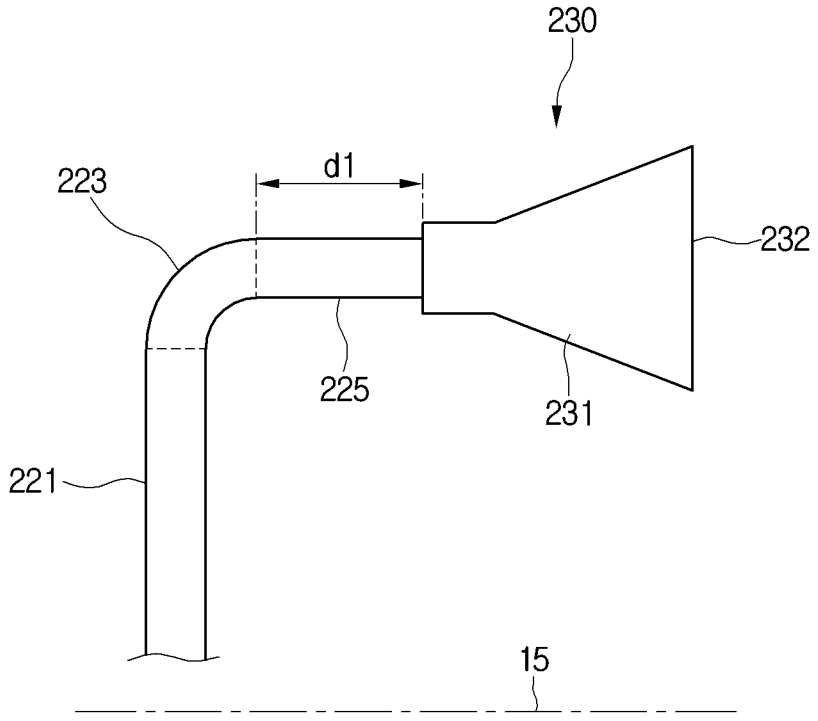
FIG. 7 is a view illustrating constitutions of the distributor and a connection tube according to the first embodiment.
Figure 8:
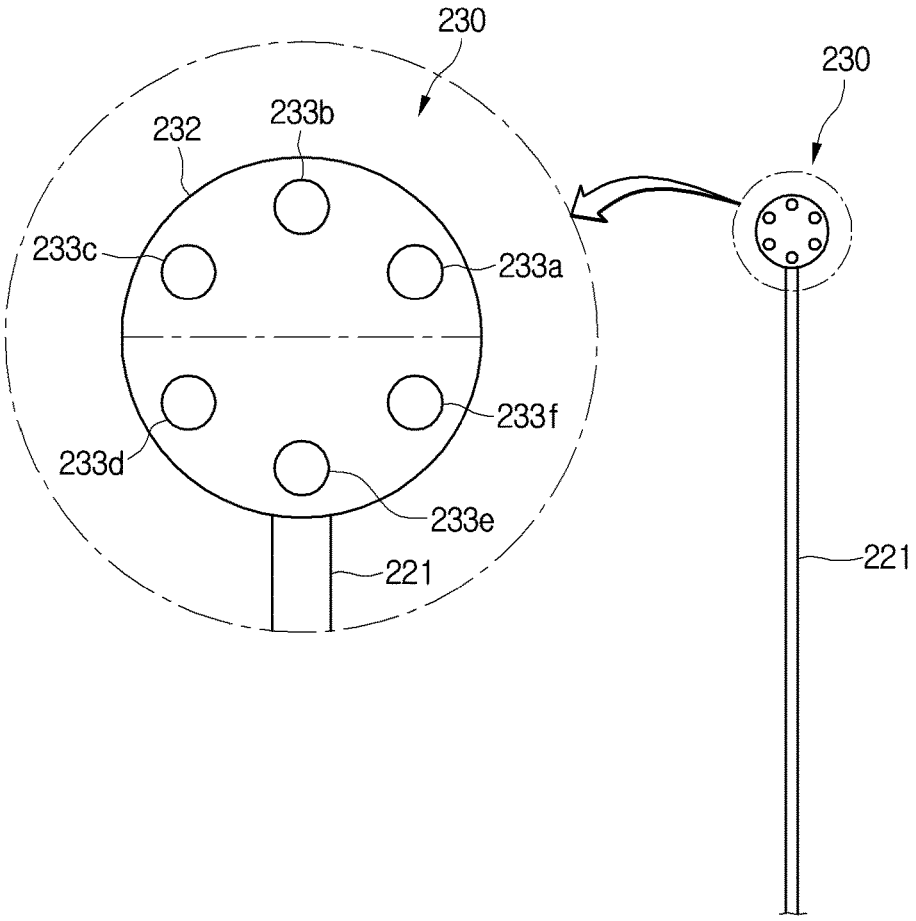
FIG. 8 is a view illustrating constitutions of a tube coupling part of the distributor according to the first embodiment.
Figure 9:
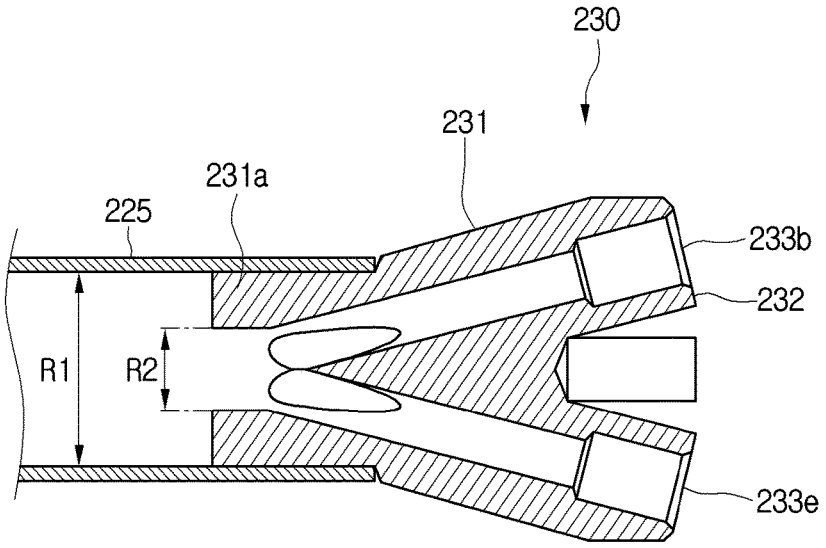
FIG. 9 is a cross-sectional view illustrating constitutions of the distributor and an inlet tube according to the first embodiment.

FIG. 7 is a view illustrating constitutions of the distributor and the connection tube according to the first embodiment, FIG. 8 is a view illustrating constitutions of a tube coupling part of the distributor according to the first embodiment, and FIG. 9 is a cross-sectional view illustrating constitutions of the distributor and the inlet tube according to the first embodiment.

Referring to FIGS. 7 and 8, the air conditioner according to the first embodiment includes the distributor 230 including one inflow part and a plurality of discharge parts, the inlet tube 225 connected to the inflow part of the distributor 230 to extend horizontally, the guide tube 221 guiding the refrigerant to flow upward, and the bending part 223 connecting the inlet tube 225 to the guide tube 221.

The bending part 223 is bent from an approximately vertical direction to an approximately horizontal direction. While the refrigerant flows from the guide tube 221 into the inlet tube 225 via the bending part 223, a liquid refrigerant may flow through an upper or lower portion of the inlet tube 225 according to a flow rate of the refrigerant.

Also, the inlet tube 225 may have a length d1 greater than a preset length so that the refrigerant flows into the upper or lower portion of the inlet tube 225 and then is introduced into the distributor 230. The length d1 of the inlet tube 225 may be above about 30 mm.

The distributor 230 includes a distributor body 231 defining a flow space for the refrigerant and a tube coupling part 232 defining one surface of the distributor body 231 and coupled to the plurality of capillary tubes 207.

The distributor 230 may disposed in parallel to the base 15 by the inlet tube 225 that extends in a horizontal direction.

The distributor body 232 may have a shape that gradually increases in flow section with respect to the flow direction of the refrigerant. Also, the tube coupling part 232 defines a surface that is approximately perpendicular to the base 15.

The tube coupling part 232 includes a plurality of coupling holes 233*a*, 233*b*, 233*c*, 233*d*, 233*e*, and 233*f* to which the plurality of capillary tubes 207 are coupled. The plurality of coupling holes include first, second, and third coupling holes 233*a*, 233*b*, and 233*c* defined in an upper portion of the distributor body 231 or the tube coupling part 232, and fourth, fifth, and sixth coupling holes 233*d*, 233*e*, and 233*f* defined in a lower portion of the distributor body 231 or the tube coupling part 232.

Although the six coupling holes are defined in the distributor 230, and the six paths for the refrigerant flowing into the outdoor heat exchanger 200 are provided in the present embodiment, the present disclosure is not limited to the number of coupling holes.

For example, the low-wind speed side of the outdoor heat exchanger 200, i.e., the capillary tube 207 connected to the portion f of FIG. 6 may be coupled to the first coupling hole 233*a*. Also, the low-wind speed side of the outdoor heat exchanger 200, i.e., the capillary tube 207 connected to the portion e of FIG. 6 may be coupled to the second coupling hole 233*b*.

The low-wind speed side of the outdoor heat exchanger 200, i.e., the capillary tube 207 connected to the portion d of FIG. 6 may be coupled to the third coupling hole 233*c*. Also, the high-wind speed side of the outdoor heat exchanger 200, i.e., the capillary tube 207 connected to the portion c of FIG. 6 may be coupled to the fourth coupling hole 233*d*.

The high-wind speed side of the outdoor heat exchanger 200, i.e., the capillary tube 207 connected to the portion b of FIG. 6 may be coupled to the fifth coupling hole 233*e*. Also, the high-wind speed side of the outdoor heat exchanger 200, i.e., the capillary tube 207 connected to the portion a of FIG. 6 may be coupled to the sixth coupling hole 233*f*.

Thus, the first, second, and third coupling holes 233*a*, 233*b*, and 233*c*, which are defined in the upper portion of the distributor 230, of the plurality of coupling holes may be connected to the low-wind speed side of the outdoor heat exchanger 200 through the capillary tubes 207 having a relatively long length. Also, the fourth, fifth, and sixth coupling holes 233*d*, 233*e*, and 233*f*, which are defined in the lower portion of the distributor 230, of the plurality of coupling holes may be connected to the high-wind speed side of the outdoor heat exchanger 200 through the capillary tubes 207 having a relatively short length.

The first second, and third coupling holes 233*a*, 233*b*, and 233*c* may be called "upper coupling holes", and the fourth, fifth, and sixth coupling holes 233*d*, 233*e*, and 233*f* may be called "lower coupling holes".

Referring to FIG. 9, the inlet tube 225 may be coupled to the inflow part 231*a* of the distributor 230. For example, the inflow part 231*a* of the distributor 230 may be inserted into the inlet tube 225. Here, the inflow part 231*a* may be formed by using at least one portion of the distributor body 231 as an axial tube and thus may be called an "axial tube".

The inlet tube 225 has an inner diameter R1 greater than that R2 of the inflow part 231*a* of the distributor 230. Thus, when the refrigerant flowing into the inlet tube 225 is introduced into the distributor 230 through the inflow part 231*a* of the distributor 230, a mixing effect of the refrigerant may be obtained.

Thus, a difference in humidity of the refrigerant may be very large in the upper and lower portions of the distributor to prevent a phenomenon from occurring in which the degree of the superheat of the refrigerant is not optimized after passing through the outdoor heat exchanger 200. Particularly, when the air conditioner operates at the rated load to allow the refrigerant having the rated rate to be introduced into the distributor 230, the mixing effect of the refrigerant may be obtained. Also, the difference in humidity of the refrigerant in the upper and lower portions of the distributor 230 may continuously change by the mixing effect.

Figure 10:
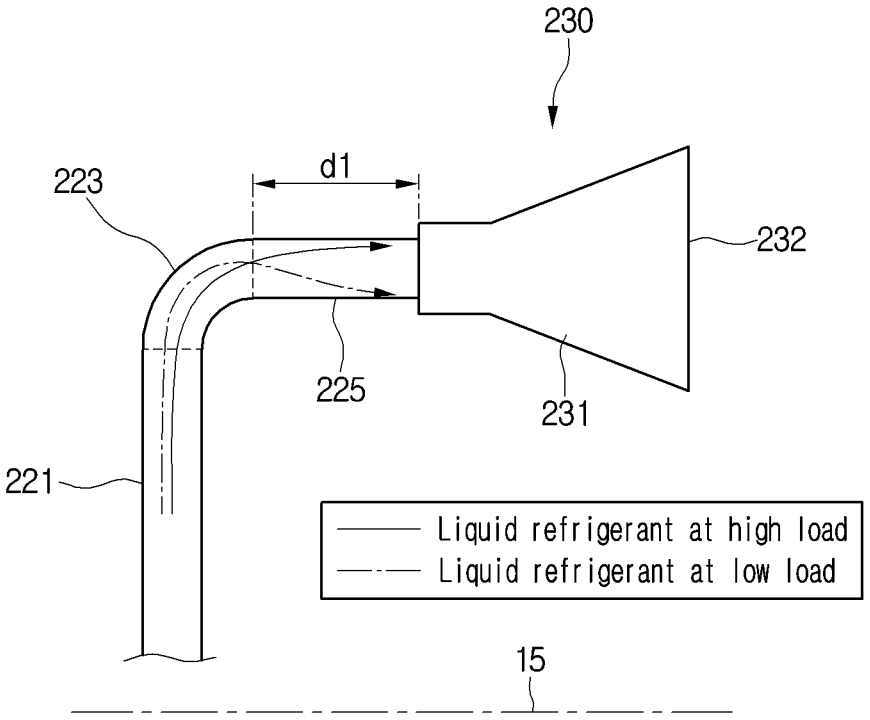
FIG. 10 is a view illustrating a refrigerant flow in the inlet tube according to the first embodiment.

FIG. 10 is a view illustrating a refrigerant flow in the inlet tube according to the first embodiment.

Referring to FIG. 10, in the connection structure of the distributor 230 according to the first embodiment, when the air conditioner 10 performs at the high load operation and low load operation, a flow of the refrigerant may change.

For example, when the air conditioner 10 operates at the high load to introduce a relatively large amount of refrigerant, i.e., the refrigerant having the rated rate toward the distributor 230, a centrifugal force acting when the refrigerant is switched in flow direction from the guide tube 221 to the inlet tube 225 via the bending part 223 may be greater than the gravity.

Thus, the liquid refrigerant having a relatively large specific gravity may be introduced into the outside of the passage of the refrigerant that is switched in flow direction, i.e., into the distributor 230 via the upper portion of the inlet tube 225. As a result, the humidity of the upper portion of the inlet tube 225 may be lower than that of the lower portion of the inlet tube 225.

Also, since the refrigerant is mixed in the inflow part 231*a* while being introduced into the distributor 230, a difference in humidity of the refrigerant at the upper and lower portions of the distributor 230 may be reduced.

On the other hand, when the air conditioner 10 operates at the low load to introduce a relatively small amount of refrigerant, i.e., the refrigerant having the low flow rate toward the distributor 230, the gravity when the refrigerant is switched in flow direction from the guide tube 221 to the inlet tube 225 via the bending part 223 may be greater than the centrifugal force.

Thus, the liquid refrigerant having a relatively large specific gravity may be introduced into the inside of the passage of the refrigerant that is switched in flow direction, i.e., into the distributor 230 via the lower portion of the inlet tube 225. As a result, the humidity of the lower portion of the inlet tube 225 may be lower than that of the upper portion of the inlet tube 225.

Since the flow rate of the refrigerant is less, the mixing effect of the refrigerant in the inflow part 231*a* while being introduced into the distributor 230 may be relatively less. Thus, the low-humidity refrigerant in the lower portion of the distributor 230 may be introduced into the high-wind speed side of the outdoor heat exchanger 200 through the fourth, fifth, and sixth coupling holes 233*d*, 233*e*, and 233*f*, and the high-humidity refrigerant in the upper portion of the distributor 230 may be introduced into the low-wind speed side of the outdoor heat exchanger 200 through the first, second, and third coupling holes 233*a*, 233*b*, and 233*c*.

Figure 11A:
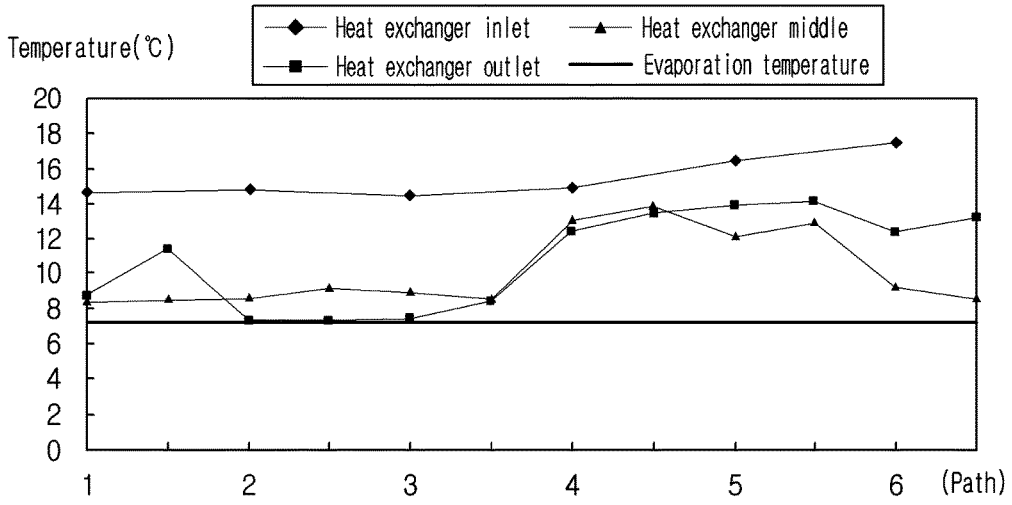
FIGS. 11A and 11B are graphs illustrating a temperature distribution of a refrigerant passing through the heat exchanger along a refrigerant path of the heat exchanger according to the first embodiment.
Figure 11B:
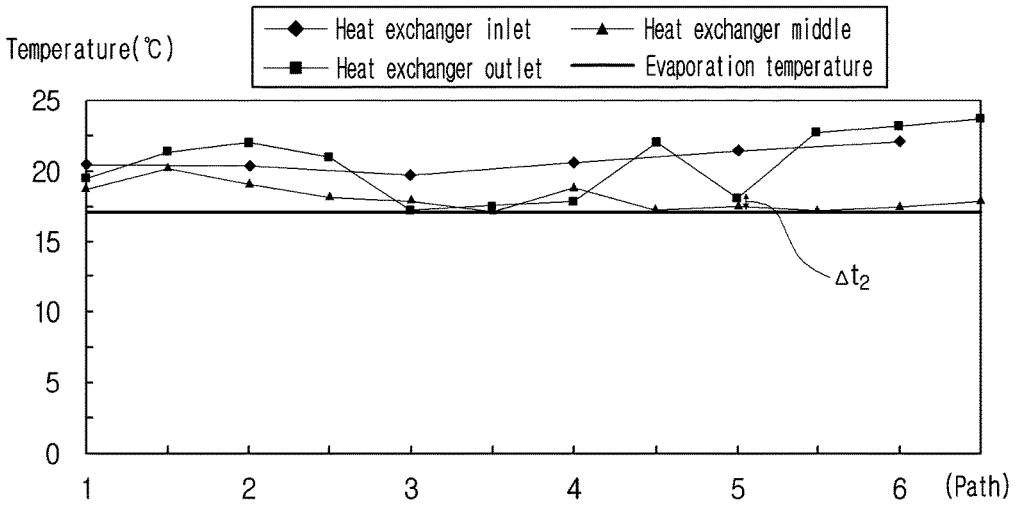

FIGS. 11A and 11B are graphs illustrating a temperature distribution of a refrigerant passing through the heat exchanger along a refrigerant path of the heat exchanger according to the first embodiment.

FIG. 11A illustrates a temperature variation and evaporation temperature at an inlet, a middle portion, and outlet of the heat exchanger for each path of the heat exchanger, to which the distributor 230 and the connection structure of the distributor 230 are applied, when the air conditioner performs the rated load operation according to the first embodiment. The evaporation temperature may be understood as a temperature after the refrigerants of the plurality of paths, which pass through the heat exchanger, are mixed with each other.

Also, FIG. 11B illustrates a temperature variation and evaporation temperature at the inlet, the middle portion, and the outlet of the heat exchanger for each path of the heat exchanger when the air conditioner operates at the low load.

Referring to FIG. 11B, the degree of the superheat may be determined as a difference value between the evaporation temperature and the outlet temperature in each path. In the case of the paths 1 to 6 of the heat exchanger, the degree of superheat may correspond to a temperature of about 1° C. to about 2° C.

Figure 1:
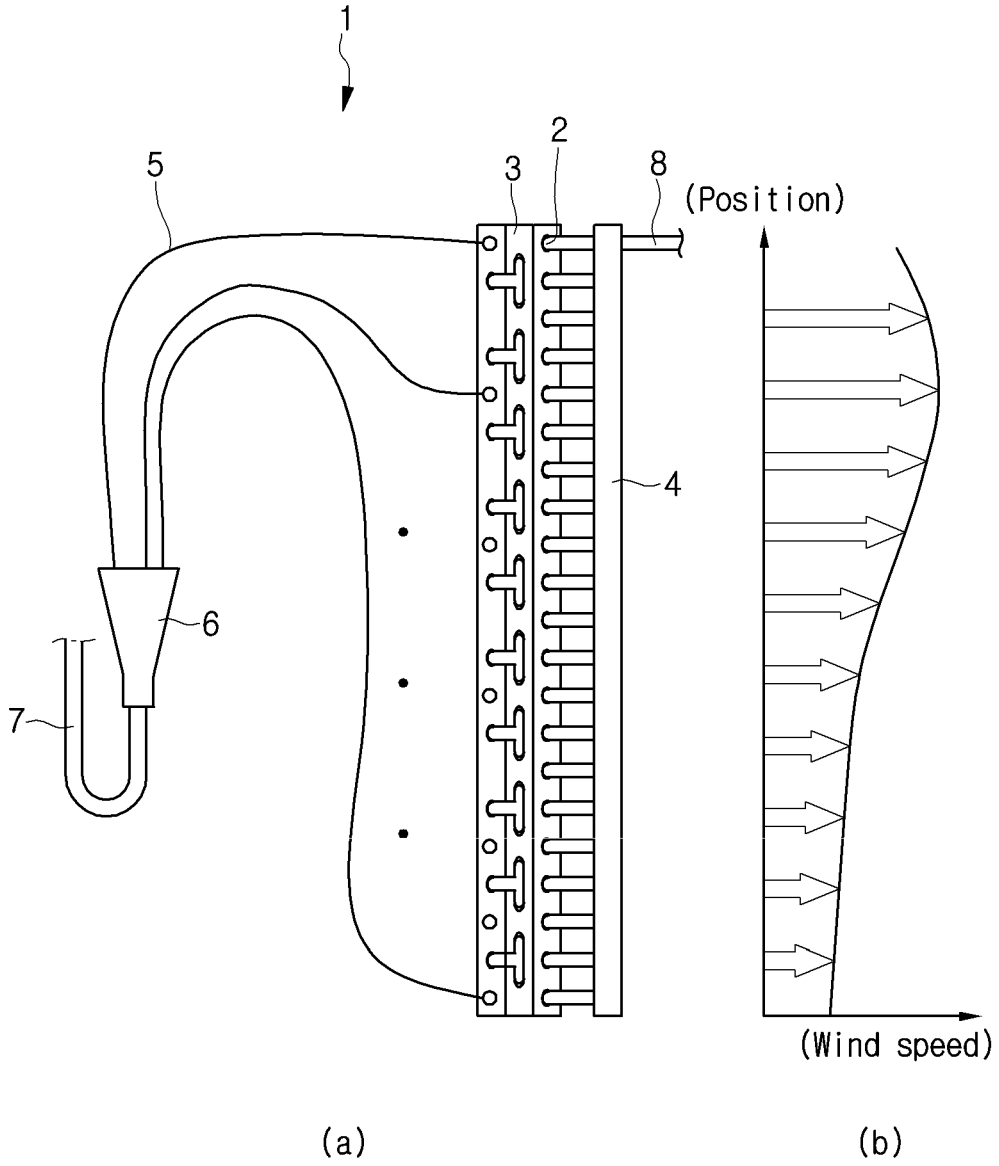
FIG.1 Related Art
FIG. 1 is a view illustrating a distributor and a variation in speed of wind passing through a heat exchanger according to a related art.
Figure 2A:
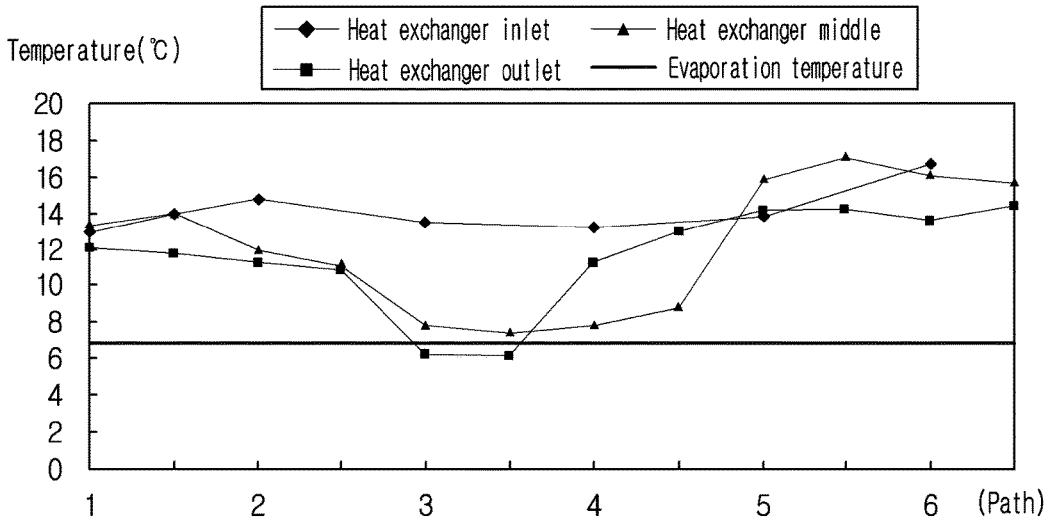
FIG.2A Related Art
FIGS. 2A and 2B are graphs illustrating a temperature distribution of a refrigerant passing through the heat exchanger along a refrigerant path of the heat exchanger according to the related art.
Figure 2B:
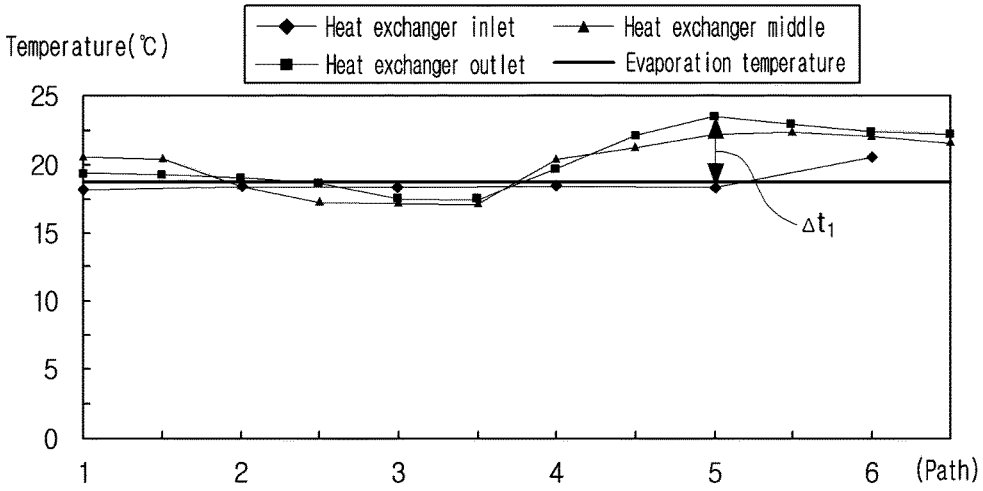
FIG.2B Related Art

This is seen that a deviation in degree of the superheat is not large when compared to the case in which the degree of the superheat correspond to that of the related art illustrated in FIG. 2B, a temperature of about 1° C. to about 5° C.

Figure 12:
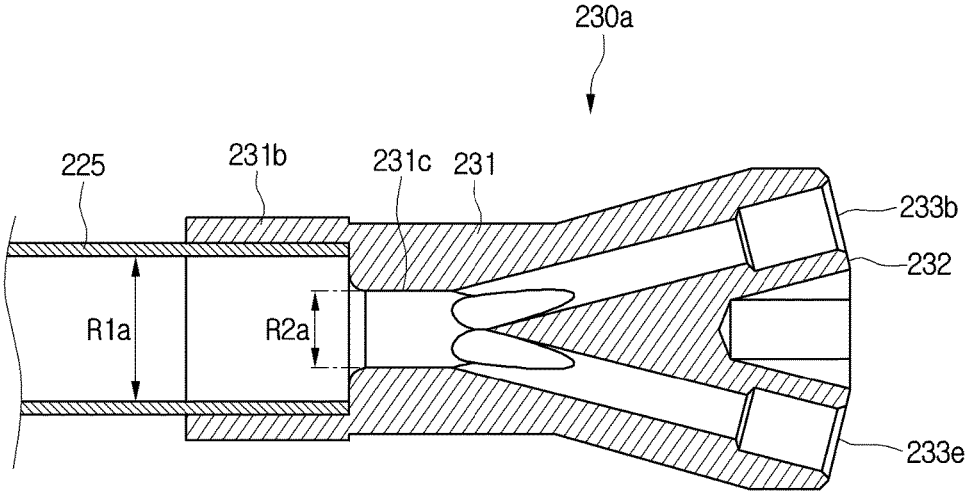
FIG. 12 is a cross-sectional view illustrating constitutions of a distributor and an inlet tube according to a second embodiment.

FIG. 12 is a cross-sectional view illustrating constitutions of a distributor and an inlet tube according to a second embodiment.

Referring to FIG. 12, an inlet tube 225 according to a second embodiment may be coupled to an expanded tube part 231*b* of a distributor 230. For example, the inlet tube 225 may be inserted into the expanded tube part 231*b* of the distributor 230. Here, the expanded tube part 231*b* may be formed by expanding at least one portion of a distributor body 231.

The distributor 230 further includes an inflow part 231*c* extending from the expanded tube part 231*b* toward a tube coupling part 232 and having an inner diameter less than that of the expanded tube part 231*b*.

The inlet tube 225 has an inner diameter R1*a* greater than that R2*a* of the inflow part 231*c* of the distributor 230. Thus, when the refrigerant flowing into the inlet tube 225 is introduced into the distributor 230 through the inflow part 231*c* of the distributor 230, a mixing effect of the refrigerant may be obtained.

Thus, a difference in humidity of the refrigerant may be very large in upper and lower portions of the distributor 230 to prevent a phenomenon from occurring in which the degree of the superheat of the refrigerant is not optimized after passing through an outdoor heat exchanger 200. Particularly, when the air conditioner operates at a rated load to allow the refrigerant having a rated rate to be introduced into the distributor 230, the mixing effect of the refrigerant may be obtained. Also, the difference in humidity of the refrigerant in the upper and lower portions of the distributor 230 may continuously change by the mixing effect.

Figure 13:
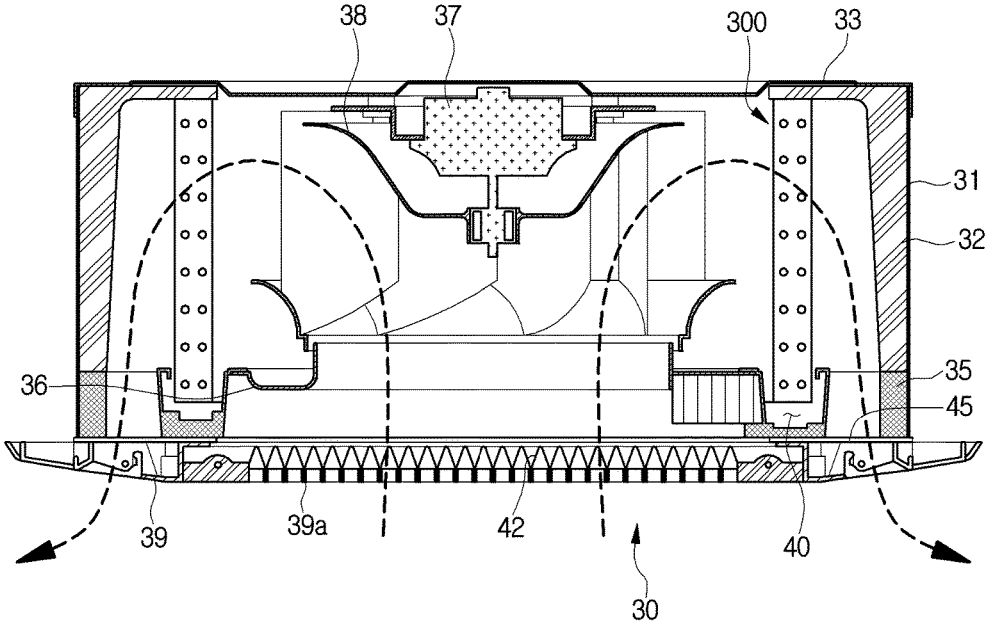
FIG. 13 is a cross-sectional view illustrating constitutions of an indoor unit according to a third embodiment.
Figure 14:
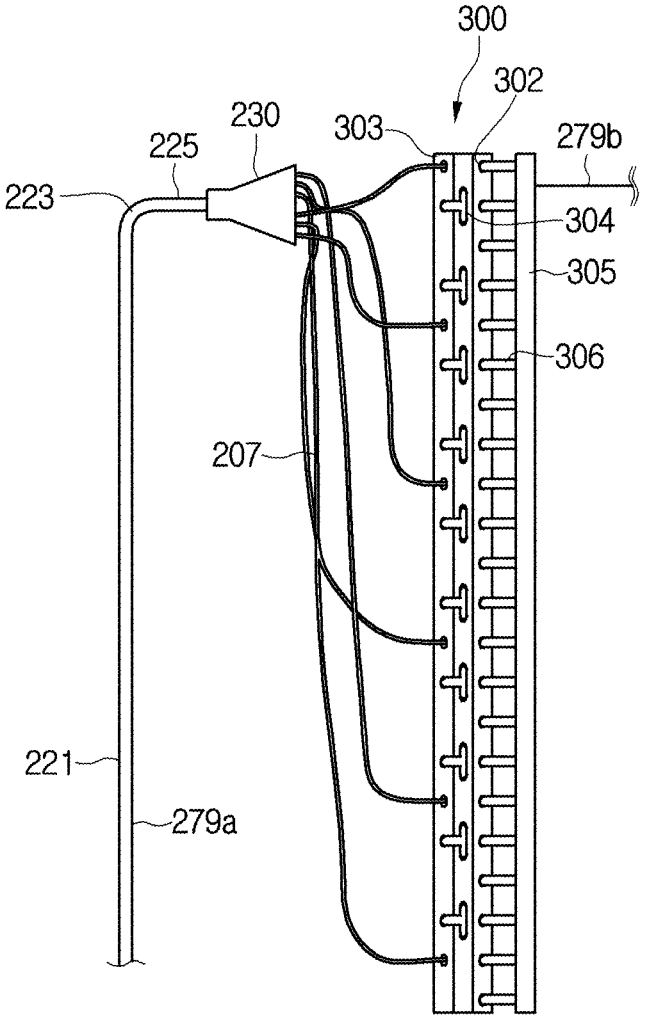
FIG. 14 is a view illustrating constitutions of the distributor connected to an indoor heat exchanger according to the third embodiment.

FIG. 13 is a cross-sectional view illustrating constitutions of an indoor unit according to a third embodiment, and FIG. 14 is a view illustrating constitutions of the distributor connected to an indoor heat exchanger according to the third embodiment.

Referring to FIG. 13, an indoor unit 30 according to a third embodiment includes a cabinet 31 defining an exterior thereof, a case 32 inserted into the cabinet 31 to protect inner components, an indoor heat exchanger 300 disposed in the case 32 and mounted to be spaced inward from the case 32, fan assemblies 37 and 38 disposed in the indoor heat exchanger 300, a drain pan 35 seated on a lower portion of the indoor heat exchanger 300 to receive condensate water formed on a surface of the indoor heat exchanger 300, a shroud disposed in the drain pan 35 to guide suction of indoor air, and a front panel 39 seated on a lower portion of the drain pan 35 to cover the case 32.

The fan assemblies include a fan motor 37 and a blower fan 38 connected to a rotation shaft of the fan motor 37 to rotate, thereby suctioning the indoor air. Also, a centrifugal fan that suctions air in an axial direction to discharge the suctioned air in a radius direction, particularly, a turbo fan may be used as the blower fan 38. Also, the fan motor 37 is fixed and mounted on a base 33 by a motor mount.

Also, a suction grille 39*a* for suctioning the indoor air is mounted on the front panel 39, and a filter 42 for filtering the suctioned indoor air is mounted on an inner surface of the suction grille 39*a*. Also, discharge holes 45 through which the suctioned indoor air is discharged are defined in four edge surfaces of the front panel 39, and each of the discharge holes 45 is selectively opened or closed by a louver.

A recess part 40 in which a lower end of the indoor heat exchanger 300 is accommodated is defined in a lower portion of the drain pan 35. In detail, the recess part 40 provides a space in which the condensate water generated on the surface of the indoor heat exchanger 300 drops down and collected. A drain pump (not shown) for draining the condensate water is mounted in the recess part 40.

Also, an orifice 36 bent at a predetermine curvature to minimize flow resistance while the indoor air is suctioned may be disposed inside the shroud. The orifice 36 extends in a cylindrical shape toward the blower fan 38.

Referring to FIG. 14, the indoor heat exchanger 300 according to the third embodiment further includes a plurality of refrigerant tubes 302 and a coupling plate 303 supporting the refrigerant tubes 302. The coupling plate 303 may be provided in plurality to support one side and the other side of each of the refrigerant tubes 302 each of which has the bent shape.

The indoor heat exchanger 300 further include a return tube 304 coupled to an end of each of the plurality of refrigerant tubes 302 to guide the refrigerant flowing in one refrigerant tube 302 into the other refrigerant tube 302.

In the indoor heat exchanger 300, a header 305 defining a flow space for the refrigerant and a plurality of refrigerant inflow tubes 306 disposed between the header 305 and the coupling plate 303 extend.

The distributor 230, the capillary tubes 207, the guide tube 221, the bending part 223, and the inlet tube 225, which are described in the foregoing embodiment, may be disposed on one side of the indoor heat exchanger 300. Descriptions of the above-described components will be quoted from those of the foregoing embodiment.

The inlet tube 225 extends in parallel to a front surface of the indoor unit 30, i.e., the front panel 39. Here, in a state where the indoor unit 300 is installed on a ceiling, the front panel 39 may face the floor. Also, the front panel 39 may extend in a direction that is approximately perpendicular to that in which the gravity is applied.

A second connection tube 279*b* of first and second connection tubes 279*a* and 279*b* is connected to the header 305, and the first connection tube 279*a* is connected to the guide tube 221.

When an air conditioner performs a cooling operation, the indoor heat exchanger 300 serves as an evaporator. In detail, the refrigerant is introduced into the distributor 230 through the first connection tube 279*a*, the guide tube 221, the bending part 223, and the inlet tube 225 and then is introduced into the indoor heat exchanger 300 through a plurality of capillary tubes 207.

Also, the refrigerant discharged from the indoor heat exchanger 300 may be introduced into a flow switching part 130 through the second connection tube 279*b*.

Figure 15:
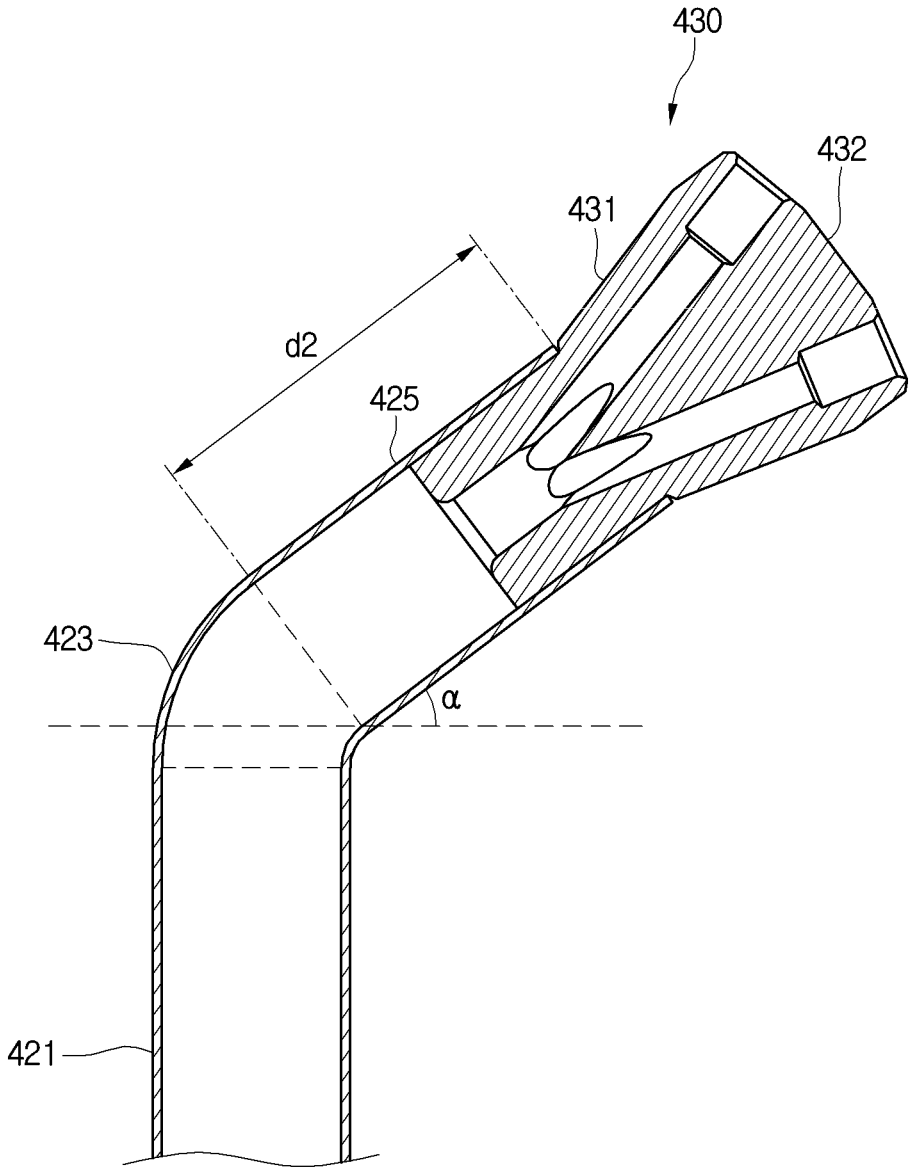
FIGS. 15 and 16 are views illustrating constitutions of a distributor and an inlet tube according to a fourth embodiment.
Figure 16:
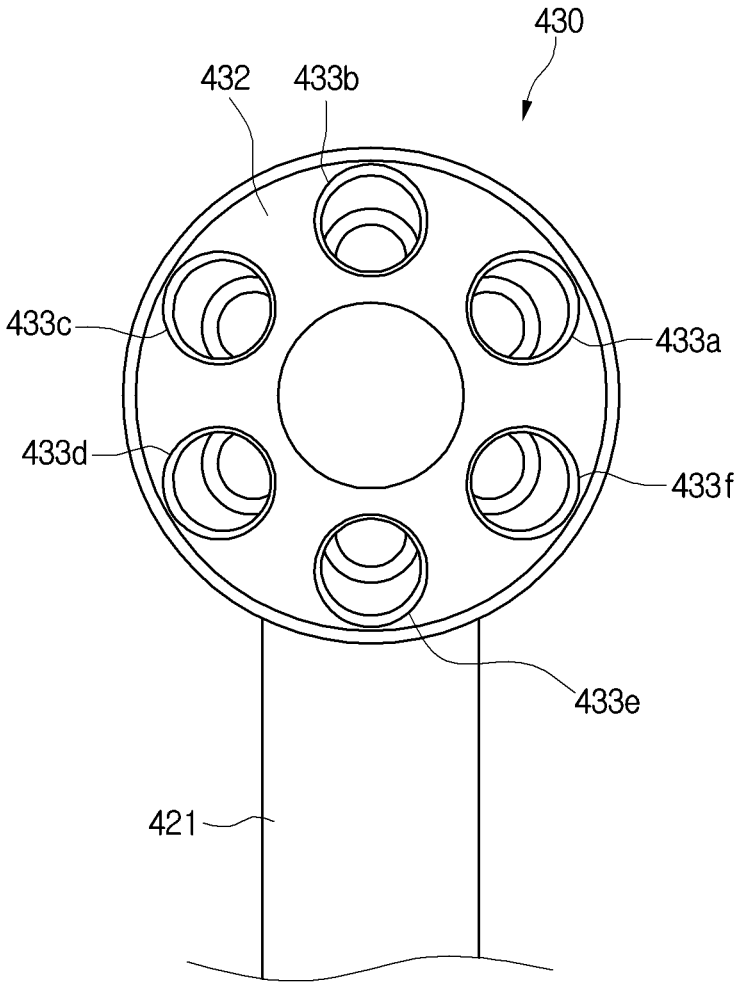
Figure 17:
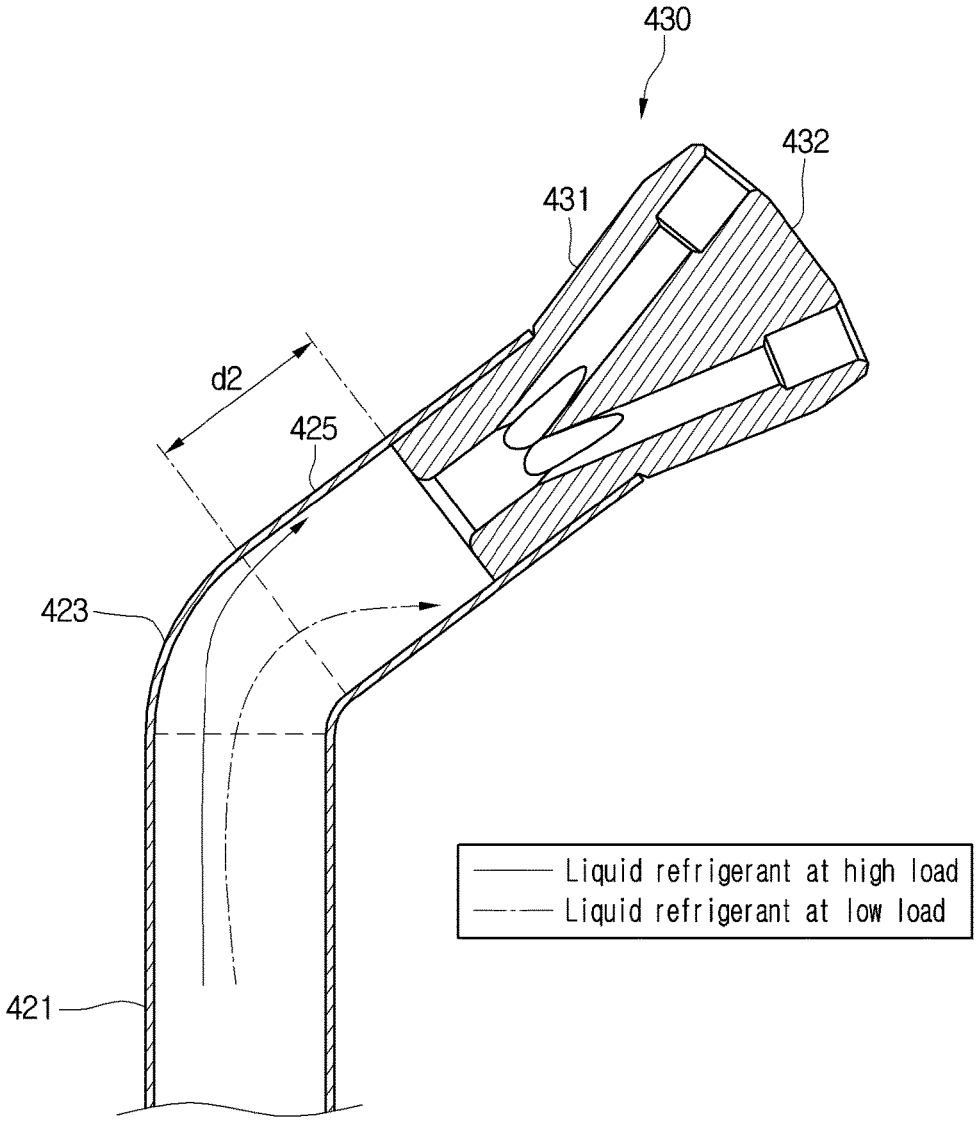
FIG. 17 is a view illustrating a refrigerant flow in the inlet tube according to the fourth embodiment.

FIGS. 15 and 16 are views illustrating constitutions of a distributor and an inlet tube according to a fourth embodiment, and FIG. 17 is a view illustrating a refrigerant flow in the inlet tube according to the fourth embodiment.

Referring to FIGS. 15 and 16, an air conditioner 10 according to a fourth embodiment includes a distributor 430 including one inflow part and a plurality of discharge parts, an inlet tube 425 connected to the inflow part of the distributor 430 to inclinedly extend upward, a guide tube 421 extending upward to guide an upward flow of a refrigerant, and a bending part 423 connecting the inlet tube 425 to the guide tube 421.

The inlet tube 425 inclinedly extends downward from the bending part 423 toward the distributor 430. That is to say, the inlet tube 425 extends from the bending part 423 in a direction that is inclined upward with respect to a direction of the gravity.

An angle $\alpha$ between the inlet tube 425 and a base 15 of an outdoor unit 10*a* may be determined at an angle of about 0° to about 90°. That is, the angle $\alpha$ may be determined at an angle of about 0° to about 45°. For example, when the angle $\alpha$ is greater than about 45°, the vertical extension of the inlet tube 425 may substantially increase. Thus, superheat of the refrigerant at an outlet side of a high-wind speed-side refrigerant tube may be observed.

The bending part 423 is inclinedly bent upward from the guide tube 421. While the refrigerant flows from the guide tube 421 into the inlet tube 425 via the bending part 423, a liquid refrigerant may flow through an upper or lower portion of the inlet tube 425 according to a flow rate of the refrigerant.

Also, the inlet tube 425 may have a length d2 greater than a preset length so that the refrigerant flows into the upper or lower portion of the inlet tube 425 and then is introduced into the distributor 430. The length d2 of the inlet tube 425 may be above about 30 mm.

The distributor 430 includes a distributor body 431 defining a flow space for the refrigerant and a tube coupling part 432 defining one surface of the distributor body 431 and coupled to the plurality of capillary tubes 207.

The distributor body 432 may have a shape that gradually increases in flow section with respect to the flow direction of the refrigerant.

The tube coupling part 432 includes a plurality of coupling holes 433*a*, 433*b*, 433*c*, 433*d*, 433*e*, and 433*f* to which the plurality of capillary tubes 207 are coupled. The plurality of coupling holes include first, second, and third coupling holes 433*a*, 433*b*, and 433*c* defined in an upper portion of the distributor body 431 or the tube coupling part 432 and fourth, fifth, and sixth coupling holes 433*d*, 433*e*, and 433*f* defined in a lower portion of the distributor body 431 or the tube coupling part 432.

For example, a low-wind speed side of the outdoor heat exchanger 200, i.e., the capillary tube 207 connected to the portion f of FIG. 6 may be coupled to the first coupling hole 433*a*. Also, the low-wind speed side of the outdoor heat exchanger 200, i.e., the capillary tube 207 connected to the portion e of FIG. 6 may be coupled to the second coupling hole 433*b*.

The low-wind speed side of the outdoor heat exchanger 200, i.e., the capillary tube 207 connected to the portion d of FIG. 6 may be coupled to the third coupling hole 433*c*. Also, a high-wind speed side of the outdoor heat exchanger 200, i.e., the capillary tube 207 connected to the portion c of FIG. 6 may be coupled to the fourth coupling hole 433*d*.

The high-wind speed side of the outdoor heat exchanger 200, i.e., the capillary tube 207 connected to the portion b of FIG. 6 may be coupled to the fifth coupling hole 433*e*. Also, the high-wind speed side of the outdoor heat exchanger 200, i.e., the capillary tube 207 connected to the portion a of FIG. 6 may be coupled to the sixth coupling hole 433*f*.

Thus, the first, second, and third coupling holes 433*a*, 433*b*, and 433*c*, which are defined in the upper portion of the distributor 430, of the plurality of coupling holes may be connected to the low-wind speed side of the outdoor heat exchanger 200 through the capillary tubes 207 having a relatively long length. Also, the fourth, fifth, and sixth coupling holes 433*d*, 433*e*, and 433*f*, which are defined in the lower portion of the distributor 430, of the plurality of coupling holes may be connected to the high-wind speed side of the outdoor heat exchanger 200 through the capillary tubes 207 having a relatively short length.

The structures of the upwardly inclined inlet tube and distributor may be applied to the indoor heat exchanger as illustrated in FIGS. 13 and 14 as well as the outdoor heat exchanger. When the distributor 430 is applied to the indoor heat exchanger, an angle α between the inlet tube 425 and a front panel of the indoor unit may be determined at an angle of about 0° to about 90°. That is, the angle α may be determined at an angle of about 0° to about 45°.

Referring to FIG. 17, in the connection structure of the distributor 430 according to the fourth embodiment, when the air conditioner 10 performs at a high load operation and low load operation, a flow of the refrigerant may change.

For example, when the air conditioner 10 operates at the high load to introduce a relatively large amount of refrigerant, i.e., the refrigerant having the rated rate toward the distributor 430, a centrifugal force acting when the refrigerant is switched in flow direction from the guide tube 421 to the inlet tube 425 via the bending part 423 may be greater than the gravity.

Thus, the liquid refrigerant having a relatively large specific gravity may be introduced into the outside of the passage of the refrigerant that is switched in flow direction, i.e., into the distributor 430 via the upper portion of the inlet tube 425. As a result, the humidity of the upper portion of the inlet tube 425 may be lower than that of the lower portion of the inlet tube 425.

Also, the refrigerant flowing into the upper portion of the inlet tube 425 may flow toward a low-wind speed side of the outdoor heat exchanger 200 through the fourth, fifth, and sixth coupling holes 433*d*, 433*e*, and 433*f* of the distributor 430 and the capillary tubes 207.

On the other hand, when the air conditioner 10 operates at the low load to introduce a relatively small amount of refrigerant, i.e., the refrigerant having the low flow rate toward the distributor 430, the gravity when the refrigerant is switched in flow direction from the guide tube 421 to the inlet tube 425 via the bending part 423 may be greater than the centrifugal force.

Thus, the liquid refrigerant having a relatively large specific gravity may be introduced into the inside of the passage of the refrigerant that is switched in flow direction, i.e., into the distributor 430 via the lower portion of the inlet tube 425. As a result, the humidity of the lower portion of the inlet tube 425 may be lower than that of the upper portion of the inlet tube 425.

Also, the refrigerant flowing into the lower portion of the inlet tube 425 may flow toward a high-wind speed side of the outdoor heat exchanger 200 through the fourth, fifth, and sixth coupling holes 433*d*, 433*e*, and 433*f* of the distributor 430 and the capillary tubes 207.

Figure 18:
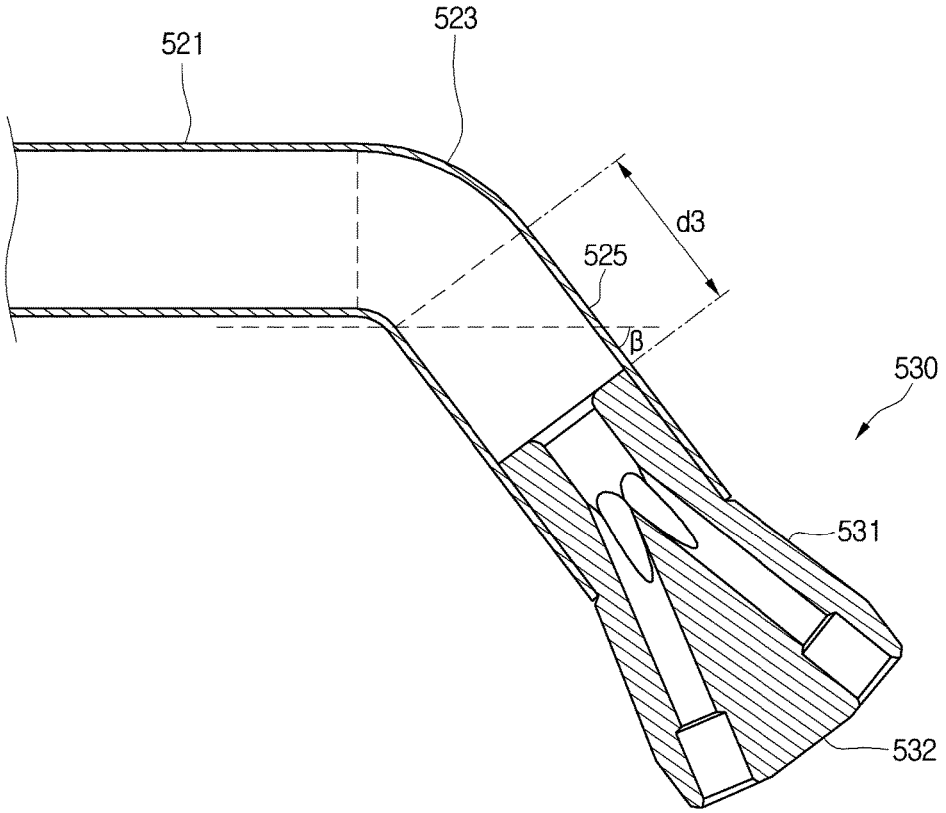
FIGS. 18 and 19 are views illustrating constitutions of a distributor and an inlet tube according to a fifth embodiment.
Figure 19:
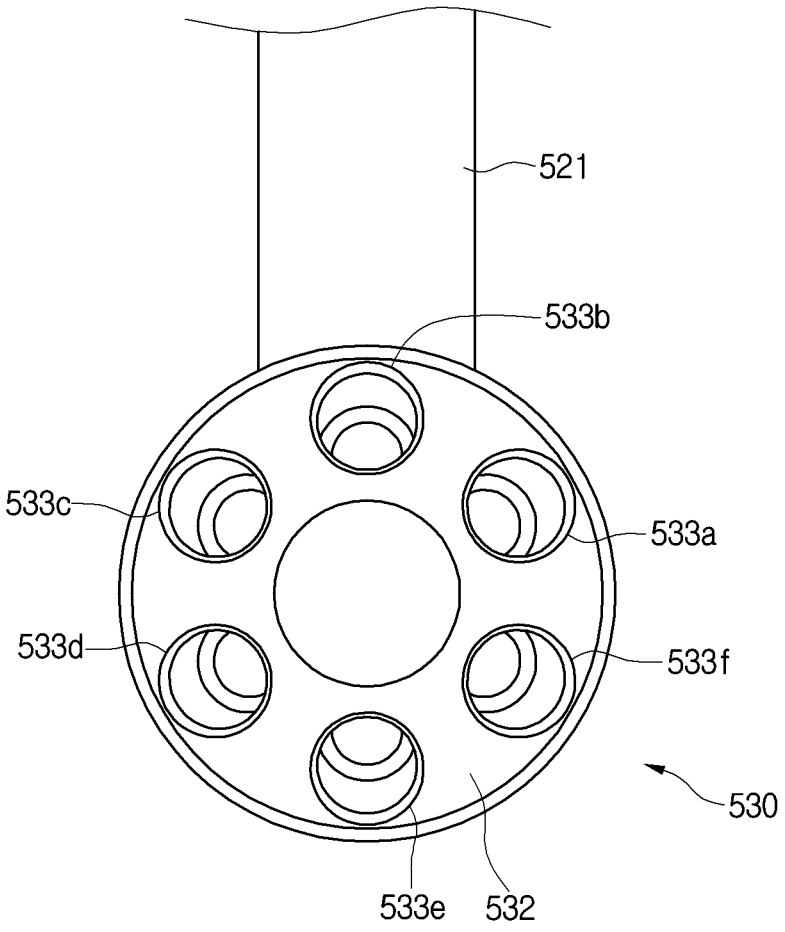
Figure 20:
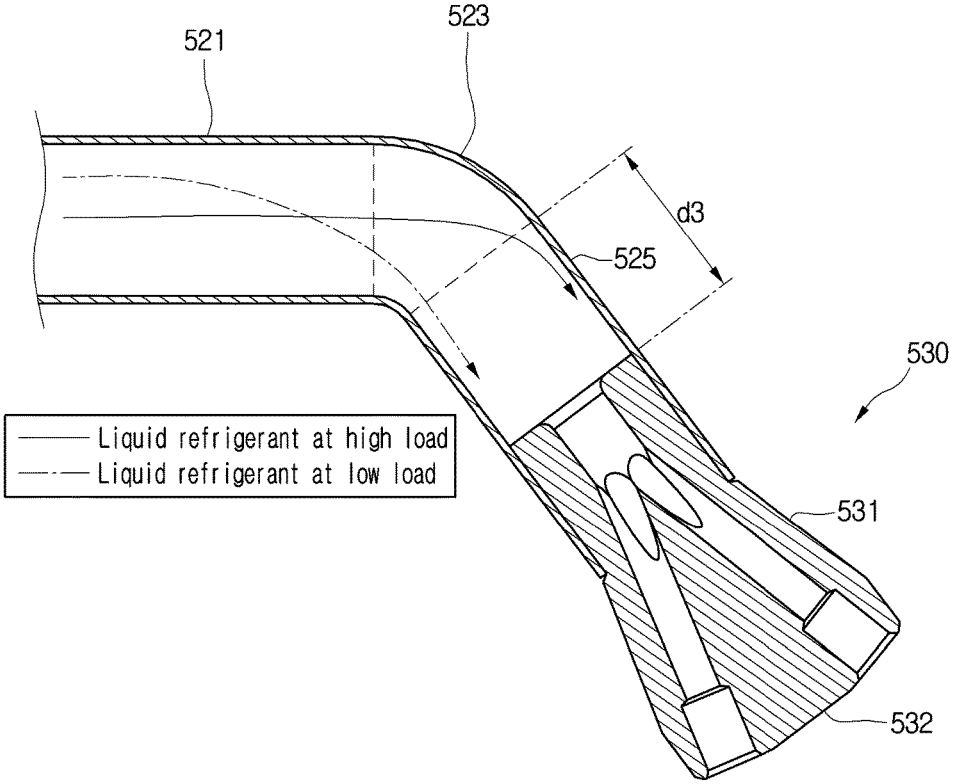
FIG. 20 is a view illustrating a refrigerant flow in the inlet tube according to the fifth embodiment.

FIGS. 18 and 19 are views illustrating constitutions of a distributor and an inlet tube according to a fifth embodiment, and FIG. 20 is a view illustrating a refrigerant flow in the inlet tube according to the fifth embodiment.

Referring to FIGS. 18 and 19, an air conditioner 10 according to a fifth embodiment includes a distributor 530 including one inflow part and a plurality of discharge parts, an inlet tube 525 connected to the inflow part of the distributor 530 to inclinedly extend downward, a guide tube 521 extending horizontally to guide a horizontal flow of a refrigerant, and a bending part 523 connecting the inlet tube 525 to the guide tube 521.

The inlet tube 525 inclinedly extends downward from the bending part 523 toward the distributor 530. That is to say, the inlet tube 525 extends from the bending part 523 in a direction that is inclined downward with respect to a direction of the gravity.

An angle β between the inlet tube 525 and a base 15 of an outdoor unit 10*a* may be determined at an angle of about 0° to about 90°. That is, the angle β may be determined at an angle of about 0° to about 45°.

The bending part 523 is inclinedly bent downward from the guide tube 521. While the refrigerant flows from the guide tube 521 into the inlet tube 525 via the bending part 523, a liquid refrigerant may flow through an upper or lower portion of the inlet tube 525 according to a flow rate of the refrigerant.

Also, the inlet tube 525 may have a length d3 greater than a preset length or more so that the refrigerant flows into the upper or lower portion of the inlet tube 525 and then is introduced into the distributor 530. The length d3 of the inlet tube 525 may be above about 30 mm.

The distributor 530 includes a distributor body 531 defining a flow space for the refrigerant and a tube coupling part 532 defining one surface of the distributor body 531 and coupled to the plurality of capillary tubes 207.

The distributor body 532 may have a shape that gradually increases in flow section with respect to the flow direction of the refrigerant.

The tube coupling part 532 includes a plurality of coupling holes 533*a*, 533*b*, 533*c*, 533*d*, 533*e*, and 533*f* to which the plurality of capillary tubes 207 are coupled. The plurality of coupling holes include first, second, and third coupling holes 533*a*, 533*b*, and 533*c* defined in an upper portion of the distributor body 431 or the tube coupling part 532 and fourth, fifth, and sixth coupling holes 533*d*, 533*e*, and 533*f* defined in a lower portion of the distributor body 531 or the tube coupling part 532.

For example, a low-wind speed side of the outdoor heat exchanger 200, i.e., the capillary tube 207 connected to the portion f of FIG. 6 may be coupled to the first coupling hole 533*a*. Also, the low-wind speed side of the outdoor heat exchanger 200, i.e., the capillary tube 207 connected to the portion e of FIG. 6 may be coupled to the second coupling hole 533*b*.

The low-wind speed side of the outdoor heat exchanger 200, i.e., the capillary tube 207 connected to the portion d of FIG. 6 may be coupled to the third coupling hole 533*c*. Also, a high-wind speed side of the outdoor heat exchanger 200, i.e., the capillary tube 207 connected to the portion c of FIG. 6 may be coupled to the fourth coupling hole 533*d*.

The high-wind speed side of the outdoor heat exchanger 200, i.e., the capillary tube 207 connected to the portion b of FIG. 6 may be coupled to the fifth coupling hole 533*e*. Also, the high-wind speed side of the outdoor heat exchanger 200, i.e., the capillary tube 207 connected to the portion a of FIG. 6 may be coupled to the sixth coupling hole 533*f*.

Thus, the first, second, and third coupling holes 533*a*, 533*b*, and 533*c*, which are defined in the upper portion of the distributor 530, of the plurality of coupling holes may be connected to the low-wind speed side of the outdoor heat exchanger 200 through the capillary tubes 207 having a relatively long length. Also, the fourth, fifth, and sixth coupling holes 533*d*, 533*e*, and 533*f*, which are defined in the lower portion of the distributor 530, of the plurality of coupling holes may be connected to the high-wind speed side of the outdoor heat exchanger 200 through the capillary tubes 207 having a relatively short length.

The structures of the downwardly inclined inlet tube and distributor may be applied to the indoor heat exchanger as illustrated in FIGS. 13 and 14 as well as the outdoor heat exchanger.

Referring to FIG. 20, in the connection structure of the distributor 530 according to the fifth embodiment, when the air conditioner 10 performs at a high load operation and low load operation, a flow of the refrigerant may change.

For example, when the air conditioner 10 operates at the high load to introduce a relatively large amount of refrigerant, i.e., the refrigerant having the rated rate toward the distributor 530, a centrifugal force acting when the refrigerant is switched in flow direction from the guide tube 521 to the inlet tube 525 via the bending part 523 may be greater than the gravity.

Thus, the liquid refrigerant having a relatively large specific gravity may be introduced into the outside of the passage of the refrigerant that is switched in flow direction, i.e., into the distributor 530 via the upper portion of the inlet tube 525. As a result, the humidity of the upper portion of the inlet tube 525 may be lower than that of the lower portion of the inlet tube 525.

Also, the refrigerant flowing into the upper portion of the inlet tube 525 may flow toward a low-wind speed side of the outdoor heat exchanger 200 through the fourth, fifth, and sixth coupling holes 533*d*, 533*e*, and 533*f* of the distributor 530 and the capillary tubes 207.

On the other hand, when the air conditioner 10 operates at the low load to introduce a relatively small amount of refrigerant, i.e., the refrigerant having the low flow rate toward the distributor 530, the gravity when the refrigerant is switched in flow direction from the guide tube 521 to the inlet tube 525 via the bending part 523 may be greater than the centrifugal force.

Thus, the liquid refrigerant having a relatively large specific gravity may be introduced into the inside of the passage of the refrigerant that is switched in flow direction, i.e., into the distributor 530 via the lower portion of the inlet tube 525. As a result, the humidity of the lower portion of the inlet tube 525 may be lower than that of the upper portion of the inlet tube 525.

Also, the refrigerant flowing into the lower portion of the inlet tube 525 may flow toward a high-wind speed side of the outdoor heat exchanger 200 through the fourth, fifth, and sixth coupling holes 533*d*, 533*e*, and 533*f* of the distributor 530 and the capillary tubes 207.

According to the embodiments, the distributor and the tube structure connected to the distributor may be improved to reduce a deviation in degree of superheat of the refrigerant passing through the heat exchanger when the heat exchanger serves as the evaporator.

In detail, the distributor may be horizontally or inclinedly disposed to allow the liquid refrigerant to be introduced into a high-wind speed side path of the heat exchanger under the rated load condition of the air conditioner, and particularly, under the low load condition. Therefore, the heat-exchange performance of the heat exchanger may be improved, and also, the deviation in a degree of superheat for each path of the refrigerant passing through the heat exchanger may be reduced.

Also, a banding part for switching a flow direction of the refrigerant may be disposed between the guide tube extending upward and the inlet tube connected to the distributor to horizontally or inclinedly extend. Thus, when a flow rate of refrigerant is less, the refrigerant having relatively low humidity may be concentrated toward one side of the inlet tube or the distributor. In addition, the one side of the distributor may be connected to the high-wind speed side of the heat exchanger to increase a heat-exchange rate of the refrigerant having the low humidity.

Also, the inlet of the distributor may have an inner diameter less than that of the inlet tube to guide the mixing of the refrigerant, thereby preventing the refrigerant flowing into the distributor from the inlet tube from significantly increasing in deviation of the humidity.

Also, the distributor and the tube structure connected to the distributor may be applied to all of the outdoor heat exchanger and the indoor heat exchanger to improve the availability of the product.

Although embodiments have been described with reference to a number of illustrative embodiments thereof, it should be understood that numerous other modifications and embodiments can be devised by those skilled in the art that will fall within the spirit and scope of the principles of this disclosure. More particularly, variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner comprising:

a heat exchanger comprising a plurality of refrigerant tubes;

a distributor configured to divide a flow of refrigerant into a plurality of flow paths;

a plurality of capillary tubes extending from an outlet-side of the distributor toward the plurality of refrigerant tubes;

an inlet tube connected to an inlet-side of the distributor;

a guide tube configured to guide the refrigerant toward the inlet tube; and a bending tube disposed between the guide tube and the inlet tube, wherein the bending tube alters a flow direction of the refrigerant such that the inlet tube extends in a horizontal direction or an inclined direction so that liquid refrigerant of a two-phase refrigerant passing through the guide tube flows into a lower portion of the inlet tube, wherein the inlet tube inclinedly extends upward or downward from the bending tube toward the distributor, and wherein the distributor comprises:

a distributor body defining a flow space for the refrigerant;

an inflow part disposed at one side of the distributor body, the inflow part defining a surface that is perpendicular to an extending direction of the inlet pipe;

a lower coupling hole defined in a lower portion of a tube coupling part to communicate with a first refrigerant tube of the plurality of refrigerant tubes that is located at a portion of the heat exchanger having a relatively higher air flow speed therethrough; and an upper coupling hole defined in an upper portion of the tube coupling part to communicate with a second refrigerant tube of the plurality of refrigerant tubes that is located at a portion of the heat exchanger having a relatively lower air flow speed therethrough.

2. The air conditioner according to claim 1, wherein the guide tube vertically extends, and the refrigerant flowing upward along the guide tube is introduced into the distributor via the bending tube and the inlet tube.

3. The air conditioner according to claim 1, wherein the heat exchanger vertically extends, and wherein the first refrigerant tube is disposed in an upper portion of the heat exchanger, and the second refrigerant tube is disposed in a lower portion of the heat exchanger.

4. The air conditioner according to claim 3, wherein a capillary tube of the plurality of capillary tubes extending from the lower coupling hole to the first refrigerant tube has a length less than that of another capillary tube of the plurality of capillary tubes extending from the upper coupling hole to the second refrigerant tube.

5. The air conditioner according to claim 1, wherein the inflow part is inserted into the inlet tube.

6. The air conditioner according to claim 5, wherein the inlet tube has an inner diameter greater than an inner diameter of the inflow part of the distributor.

7. The air conditioner according to claim 1, wherein the heat exchanger comprises an outdoor heat exchanger disposed on a horizontal base of an outdoor unit.

8. The air conditioner according to claim 7, wherein an angle between the inlet tube and the base is 0° to 45°.

9. The air conditioner according to claim 1, wherein the inlet tube has a length of about 30 mm or more.

* * * * *